US006190540B1

(12) United States Patent
Lokhandwala et al.

(10) Patent No.: US 6,190,540 B1
(45) **Date of Patent: *Feb. 20, 2001**

(54) SELECTIVE PURGING FOR HYDROPROCESSING REACTOR LOOP

(75) Inventors: Kaaeid A. Lokhandwala, Union City; Richard W. Baker, Palo Alto, both of CA (US)

(73) Assignee: Membrane Technology and Research, Inc., Menlo Park, CA (US)

( * ) Notice: Under 35 U.S.C. 154(b), the term of this patent shall be extended for 0 days.

This patent is subject to a terminal disclaimer.

(21) Appl. No.: 09/083,872

(22) Filed: May 22, 1998

(51) Int. Cl.[7] ..... C10G 45/00

(52) U.S. Cl. ..... 208/209; 208/107; 208/264; 208/100; 208/101; 208/102; 585/818

(58) Field of Search ..... 585/818; 208/107, 208/264, 209, 100, 101, 102

(56) References Cited

U.S. PATENT DOCUMENTS

| | | | | |
|---|---|---|---|---|
| 4,212,726 | * | 7/1980 | Mayes | 208/101 |
| 4,362,613 | | 12/1982 | MacLean | 208/108 |
| 4,364,820 | * | 12/1982 | DeGraff et al. | 208/101 |
| 4,367,135 | | 1/1983 | Posey, Jr. | 208/108 |
| 4,457,834 | * | 7/1984 | Caspers et al. | 208/143 |
| 4,548,619 | | 10/1985 | Steacy | 55/16 |
| 4,654,063 | | 3/1987 | Auvil et al. | 62/18 |
| 4,836,833 | | 6/1989 | Nicholas et al. | 55/16 |
| 4,857,078 | | 8/1989 | Watler | 55/16 |
| 4,892,564 | | 1/1990 | Cooley | 55/16 |
| 4,963,165 | | 10/1990 | Blume et al. | 55/16 |
| 4,980,046 | | 12/1990 | Zarchy et al. | 208/99 |
| 5,053,067 | | 10/1991 | Chretien | 62/24 |
| 5,082,481 | | 1/1992 | Barchas et al. | 62/23 |
| 5,082,551 | * | 1/1992 | Reynolds et al. | 208/100 |
| 5,157,200 | | 10/1992 | Mikkinen et al. | 585/803 |
| 5,256,295 | | 10/1993 | Baker et al. | 210/640 |
| 5,332,424 | | 7/1994 | Rao et al. | 95/47 |
| 5,354,547 | | 10/1994 | Rao et al. | 423/650 |
| 5,435,836 | | 7/1995 | Anand et al. | 95/45 |
| 5,447,559 | | 9/1995 | Rao et al. | 423/650 |
| 5,507,856 | | 4/1996 | Rao et al. | 95/50 |
| 5,634,354 | | 6/1997 | Howard et al. | 62/624 |
| 5,689,032 | | 11/1997 | Krause et al. | 585/802 |
| 5,785,739 | * | 7/1998 | Baker et al. | 95/39 |

OTHER PUBLICATIONS

"Membrane Technology for Hydrocarbon Separation," Membrane Associates Ltd.–No Month.

"Polymeric Gas Separation Membranes," Paul and Yampolski (eds.)–No Month.

H. Yamashiro, "Plant Uses Membrane Separation," Hydrocarbon Processing, Jan. 1985.

H. Yamashiro et al., "Hydrogen Purification with Cellulose Acetate Membranes," presented at Europe–Japan Congress on Membranes and Membrane Processes, Jun. 18–21, 1984.

W.A. Bollinger et al., "Optimizing Hydrocracker Hydrogen," Chemical Engineering Progress May, 1984.

J.M. Abrardo, "Hydrogen Technologies to Meet Refiners' Future Needs," Hydrocarbon Process, Feb. 1995.

W.A.Bollinger et al., "Prism™ Separators Optimize Hydrocracker Hydrogen," Paper presented at AIChE 1983 Summer National Meeting, Session No. 66, Aug. 29, 1983.

* cited by examiner

*Primary Examiner*—Marian C. Knode
*Assistant Examiner*—Nadine Preisch
(74) *Attorney, Agent, or Firm*—J. Farrant

(57) ABSTRACT

A process for hydroprocessing a fluid stream containing at least hydrogen and hydrocarbons. The process uses a hydrocarbon-selective membrane to reduce the concentration of hydrocarbons and contaminants in the hydrogen stream recycled to the hydroprocessing reactor. The membrane can operate in the presence of hydrogen sulfide. The process also provides the opportunity for increased NGL recovery from the hydrocarbon-enriched membrane permeate stream.

48 Claims, 7 Drawing Sheets

SELECTIVE PURGING FOR HYDROPROCESSING REACTOR LOOP

FIELD OF THE INVENTION

The invention relates to improved contaminant removal and hydrogen reuse in hydroprocessing reactors, by passing gases in the hydroprocessor reactor recycle loop across hydrocarbon selective membranes.

BACKGROUND OF THE INVENTION

Many operations carried out in refineries and petrochemical plants involve feeding a hydrocarbon/hydrogen stream to a reactor, withdrawing a reactor effluent stream of different hydrocarbon/hydrogen composition, separating the effluent into liquid and vapor portions, and recirculating part of the vapor stream to the reactor, so as to reuse unreacted hydrogen. Such loop operations are found, for example, in the hydrotreater, hydrocracker and catalytic reformer sections of most modern refineries, as well as in isomerization reactors and hydrodealkylation units.

The phase separation into liquid and vapor portions is often carried out in one or more steps by simply changing the pressure and/or temperature of the effluent. Therefore, in addition to hydrogen, the overhead vapor from the phase separation usually contains light hydrocarbons, particularly methane and ethane, and various contaminants, such as hydrogen sulfide, carbon dioxide, and ammonia. In a closed recycle loop, these components build up, change the reactor equilibrium conditions and can lead to reduced product yield and premature deactivation of reactor catalysts. This build-up of undesirable contaminants is usually controlled by purging a part of the vapor stream from the loop. Such a purge operation is unselective however, and, since the purge stream may contain as much as 80 vol % or more hydrogen, multiple volumes of hydrogen can be lost from the loop for every volume of contaminant that is purged. The purge stream may be treated by further separation in some downstream operation, or may simply pass to the plant fuel header.

The impetus for hydrogen recovery in the reactor loop is two-fold. First, demand for hydrogen in refineries and petrochemical plants is high, and it is almost always more cost-effective to try to reuse as much gas as is practically possible than to meet the hydrogen demand entirely from fresh stocks. Secondly, it is desirable in most operations to maintain a high hydrogen partial pressure in the reactor. The availability of ample hydrogen during the reaction step prolongs the life of the catalyst by controlling coke formation, and suppresses the formation of non-preferred, low value products. Furthermore, many streams also contain high percentages, such as 10%, 20%, 30% or more, of $C_{3+}$ hydrocarbons. The chemical value of these individual components is much higher—in some instances, as much as eight times higher—than their fuel value. The ability to recover at least some of this value would be advantageous, especially in refineries, which generally operate at narrow financial margins.

Hydrogen recovery techniques that have been deployed in refineries include, besides simple phase separation of fluids, pressure swing adsorption (PSA) and membrane separation.

U.S. Pat. No. 4,548,619, to UOP, shows membrane treatment of the overhead gas from an absorber treating effluent from benzene production. The membrane permeates the hydrogen selectively and produces a hydrogen-enriched gas product that is withdrawn from the process. U.S. Pat. No. 5,053,067, to L'Air Liquide, discloses removal of part of the hydrogen from a refinery off-gas to change the dewpoint of the gas to facilitate downstream treatment. U.S. Pat. No. 5,157,200, to Institut Francais du Petrole, shows treatment of light ends containing hydrogen and light hydrocarbons, including using a hydrogen-selective membrane to separate hydrogen from other components. U.S. Pat. No. 5,689,032, to Krause/Pasadyn, discusses a method for separating hydrogen and hydrocarbons from refinery off-gases, including multiple low-temperature condensation steps and a membrane separation step for hydrogen removal.

A chapter in "Polymeric Gas Separation Membranes", D. R. Paul et al. (Eds.) entitled "Commercial and Practical Aspects of Gas Separation Membranes", by Jay Henis describes various hydrogen separations that can be performed with hydrogen-selective membranes.

Literature from Membrane Associates Ltd., of Reading, England, shows and describes a design for pooling and downstream treating various refinery off-gases, including passing of the membrane permeate stream to subsequent treatment for LPG recovery.

U.S. Pat. No. 4,857,078, to Watler, mentions that, in natural gas liquids recovery, streams that are enriched in hydrogen can be produced as retentate by a rubbery membrane. Other references that describe membrane-based separation of hydrogen from gas streams in a general way include U.S. Pat. No. 4,654,063 and U.S. Pat. No. 4,836,833, to Air Products, and U.S. Pat. No. 4,892,564, to Cooley.

U.S. Pat. No. 5,332,424, to Air Products, describes fractionation of a gas stream containing light hydrocarbons and hydrogen using an "adsorbent membrane". The membrane is made of carbon, and selectively adsorbs hydrocarbons onto the carbon surface, allowing separation between various hydrocarbon fractions to be made. Hydrogen tends to be retained in the membrane residue stream. Other Air Products patents that show application of carbon adsorbent membranes to hydrogen/hydrocarbon separations include U.S. Pat. Nos. 5,354,547; 5,435,836; 5,447,559 and 5,507,856, which all relate to purification of streams from steam reformers. U.S. Pat. No. 5,634,354, to Air Products, discloses removal of hydrogen from hydrogen/olefin streams. In this case, the membrane used to perform the separation is either a polymeric membrane selective for hydrogen over hydrocarbons or a carbon adsorbent membrane selective for hydrocarbons over hydrogen. U.S. Pat. No. 5,082,481, to Lummus Crest, describes removal of carbon dioxide, hydrogen and water vapor from cracking effluent, the hydrogen separation being accomplished by a hydrogen-selective membrane.

The use of certain polymeric membranes to treat off-gas streams in refineries is also described in the following papers: "Hydrogen Purification with Cellulose Acetate Membranes", by H. Yamashiro et al., presented at the Europe-Japan Congress on Membranes and Membrane Processes, June 1984; "Prism™ Separators Optimize Hydrocracker Hydrogen", by W. A. Bollinger et al., presented at the AIChE 1983 Summer National Meeting, August 1983; "Plant Uses Membrane Separation", by H. Yamashiro et al., in Hydrocarbon Processing, February 1985; and "Optimizing Hydrocracker Hydrogen", by W. A. Bollinger et al., in Chemical Engineering Progress, May 1984. These papers describe system designs using cellulose acetate or similar membranes that permeate hydrogen and reject hydrocarbons. The use of membranes in refinery separations is also mentioned in "Hydrogen Technologies to Meet Refiners' Future Needs", by J. M. Abrardo et al. in Hydrocarbon Processing, February 1995. This paper points out the disadvantage of membranes, namely that they permeate the hydrogen, thereby delivering it at low pressure, and that they are susceptible to damage by hydrogen sulfide and heavy hydrocarbons.

U.S. Pat. No. 4,362,613, to Monsanto, describes a process for treating the vapor phase from a high pressure separator in a hydrocracking plant by passing the vapor across a membrane that is selectively permeable to hydrogen. The process yields a hydrogen-enriched permeate that can be recompressed and recirculated to the hydrocracker reactor. U.S. Pat. No. 4,367,135, also to Monsanto, describes a process in which effluent from a low pressure separator is treated to recover hydrogen using the same type of hydrogen-selective membrane. Because these membranes permeate the hydrogen to the low pressure side of the membrane, the permeate stream must be recompressed before being reintroduced to the hydroprocessing reactor. In addition, these types of membranes do not display good resistance to damage by water vapor or acid gases that are often present in the effluent streams.

U.S. Pat. No. 4,980,046, to UOP, discusses desulfurization of a hydroprocessor effluent by flash evaporation and/or adsorption.

SUMMARY OF THE INVENTION

The invention is a technique for hydroprocessing, for example, hydrotreating or hydrocracking, a hydrocarbon stream. A principal goal of the process is to reduce the concentration of hydrogen sulfide and other contaminants in the hydrogen gas stream recycled to the hydroprocessor. Another goal is to increase the amount of hydrogen captured for reuse in the reactors, thereby reducing the demand for hydrogen from external sources. Yet a third goal is to increase the hydrogen partial pressure in the reactors, thereby improving reactor conditions and extending catalyst life and cycle time.

To achieve these goals, the invention includes three basic steps: hydroprocessing, separation of the hydroprocessor effluent, and membrane separation of the vapor stream from the separation step.

In a basic embodiment, the process of the invention includes the following steps:

(a) hydroprocessing the fluid stream;

(b) subjecting an effluent, in some cases containing hydrogen sulfide, from the hydroprocessing step to at least one phase separation step, thereby producing a vapor stream comprising hydrogen and a light hydrocarbon;

(c) performing a membrane separation step, comprising passing at least a portion of the vapor stream across a feed side of a polymeric membrane selective to the light hydrocarbon over hydrogen;

(d) withdrawing from a permeate side of the polymeric membrane a permeate stream enriched in the light hydrocarbon compared to the vapor stream;

(e) withdrawing from the feed side a residue stream enriched in hydrogen compared to the vapor stream;

(f) recycling at least a portion of the residue stream to the hydroprocessing step.

To applicants' knowledge, such an integrated combination of steps has not previously been used in hydroprocessing.

The hydroprocessing reaction step is carried out by any of the conventional techniques known in the art. The reactor may handle any feedstock, including diverse distillates from the atmospheric and vacuum distillation columns and crackate fractions from catalytic crackers. The feedstock may contain sulfur compounds, or may be essentially sulfur-free, for example in hydrocracking.

The phase separation step may be carried out in any convenient manner, as a single-stage operation, or in multiple sub-steps. The effluent from hydrotreaters and hydrocrackers is typically a high temperature/high pressure mixture of vapor and liquid phases, so the phase separation step usually starts with progressive cooling to condense the heavier components of the stream and yield a hydrogen-rich overhead vapor. Subsequent downstream phase separation steps may be carried out by further cooling, flashing, absorption or the like. Usually, the cooled liquid phase from the high-pressure phase-separation section is reduced in pressure, thereby flashing off a light overhead gas which is sent to the fuel gas line.

The membrane separation step is preferably carried out on the hydrogen-rich overhead vapor from the first set of cooling steps, but may be carried out, alternatively or in addition, on overhead streams from subsequent phase separation steps.

The membrane separation step is characterized in that it is carried out using a polymeric separation membrane that is selective in favor of hydrocarbons and hydrogen sulfide over hydrogen, so that it produces a hydrocarbon-enriched permeate and a hydrogen-enriched residue. If hydrogen sulfide is present in the feed to the membrane unit, as will frequently be the case, it will be removed from the stream and concentrated in the permeate. Both the permeate and residue streams may optionally be subjected to additional treatment. At least in those embodiments where the membrane separation step treats the hydrogen-rich vapor from the first phase separation section, all or some of the residue stream is recirculated to the reactors. The recycling of the hydrogen to the hydroprocessor reduces the demand for hydrogen from the hydrogen plant within the refinery and can increase hydrogen partial pressure in the reactor.

This highlights an important advantage that the membrane separation step has over other membrane separation processes that have been used in the industry in the past: the polymeric membranes are hydrogen-rejecting. That is, the hydrocarbon components permeate the membrane preferentially, leaving a residue stream on the feed side that is concentrated in the slower-permeating hydrogen. This means that the hydrogen product stream is delivered at high pressure. Since one goal of the separation is often to create a source of hydrogen for reuse in the plant, the ability to deliver this hydrogen without the need for recompression is attractive.

In addition to preferentially permeating hydrocarbons, the membranes used in the invention permeate all of hydrogen sulfide, carbon dioxide, carbon monoxide, ammonia, nitrogen, and water vapor faster than hydrogen, and are capable of withstanding exposure to these components even in comparatively high concentrations. Thus, the invention may be used in hydrodesulfurization units, hydrotreaters and other reactors that produce dirty effluents, that is, effluents contaminated with the above components.

This property contrasts with cellulose acetate and like membranes, which must be protected from exposure to heavy hydrocarbons and other contaminants. Such membranes may only be used on streams that have been dehydrated and desulfurized, such as hydrocracker effluent streams. This is an important distinguishing advantage over prior art processes.

Since polymeric materials are used for the membranes, they are relatively easy and inexpensive to prepare and to house in modules, compared with other types of hydrogen-rejecting membranes, such as finely microporous inorganic membranes, including adsorbent carbon membranes, pyrolysed carbon membranes and ceramic membranes.

The membrane separation unit may be installed directly in the line containing the light hydrocarbon vapor stream from the separator. Alternatively, it may be installed in a side-loop, either from the light hydrocarbon line or from a purge line from the light hydrocarbon line. It is preferred to install the membrane system in a side-loop, so that the membrane unit can be taken off-line, if desired, without the necessity of shutting down the hydroprocessing reactor or the subsequent downstream processes. Installation of the membrane system in a side loop also facilitates retrofitting of prior art reactors.

All of the unit operations described above may be performed as single-stage operations, or may be themselves carried out in multiple sub-steps.

It is to be understood that the above summary and the following detailed description are intended to explain and illustrate the invention without restricting its scope.

DETAILED DESCRIPTION OF THE INVENTION

Figure 1:
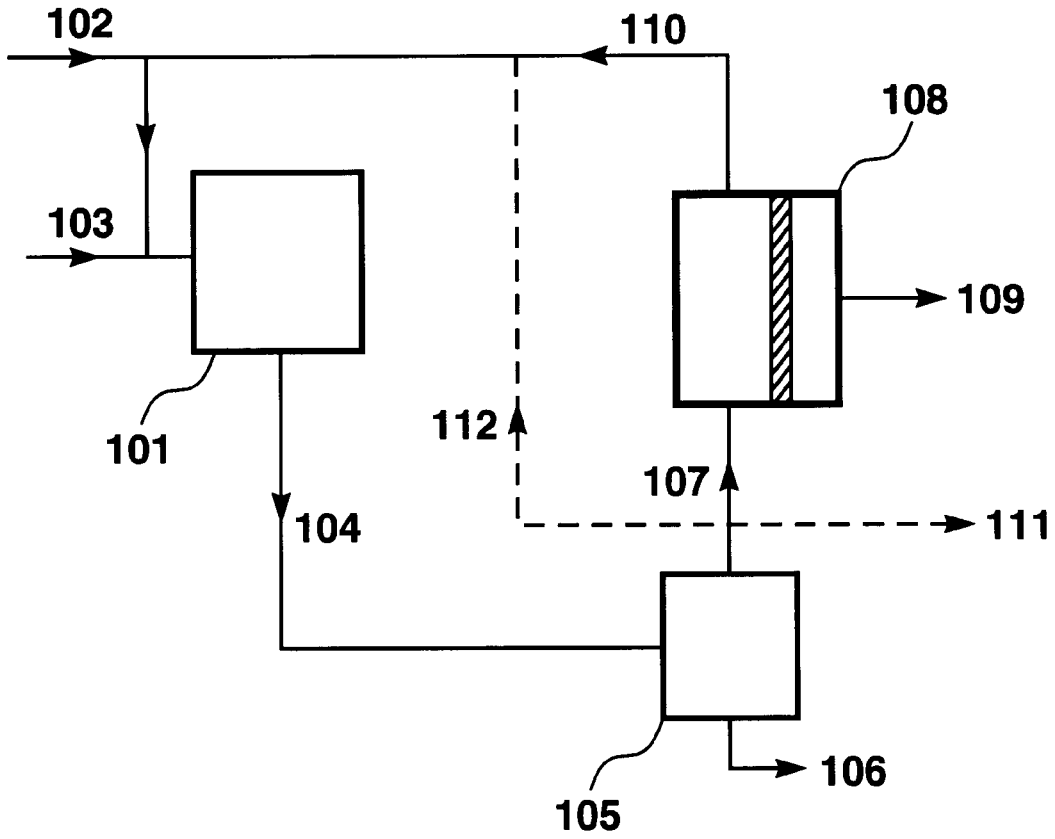
FIG. 1 is a schematic drawing showing a basic embodiment of the invention.

The term gas, as used herein, means gas or vapor.

The term $C_{2+}$ hydrocarbon means a hydrocarbon having at least two carbon atoms; the term $C_{3+}$ hydrocarbon means a hydrocarbon having at least three carbon atoms; and so on.

The term light hydrocarbon means a hydrocarbon molecule having no more than about six carbon atoms.

The term heavier hydrocarbons means $C_{3+}$ hydrocarbons.

Percentages used herein are by volume unless otherwise specified.

The invention is a technique for hydroprocessing, for example, hydrotreating or hydrocracking, a hydrocarbon stream. Hydroprocessing covers various refinery operations, including, but not limited to, catalytic hydrodesulfurization (CHD)), hydrotreating to remove other contaminants, pretreatment of reformer feedstocks, and hydrocracking to break down polycyclic aromatic compounds.

Hydrogen serves several important functions in hydroprocessing. For example, hydrogen reacts with mercaptans, disulfides, benzothiophenes and the like to form hydrogen sulfide, thereby desulfurizing the feedstock. Hydrogen reacts with quinoline and other nitrogen compounds to form ammonia. Hydrogen facilitates the cracking of polycyclic aromatics. Finally, operating in a hydrogen-rich environment reduces the formation of tar and coke, prolonging catalyst life and increasing reactor cycle time. For example, it has been estimated that a one percent increase in hydrogen purity in the hydrocracker may, under certain circumstances, increase the cycle length between hydrocracking catalyst regeneration by about one percent.

The hydrogen demands of a reactor vary, depending on the specifics of the operation being performed, and may be as low as 200 scf/bbl or less for desulfurization of naphtha or virgin light distillates, 500–1,000 scf/bbl for treating atmospheric resid, upwards of 1,000 scf/bbl for treatment of vacuum resid, and as high as 5,000–10,000 scf/bbl for hydrocracking.

Modern refineries often carry out treating and cracking operations together, such as in multi-stage reactors, where the first stage predominantly converts sulfur compounds and the second stage predominantly performs the cracking step. In conventional hydroprocessing, fresh feed is mixed with hydrogen and recycle gas and fed to the reactors, where the desired reactions take place in the presence of a suitable catalyst. As a result, light components that can be formed include methane, ethane, other light hydrocarbons, hydrogen sulfide and ammonia. The reactor effluent is passed to a first separation section, where the effluent is maintained at high pressure, but reduced in temperature, usually in at least two or three stages. At least a portion of the resulting overhead vapor, which typically contains 80% hydrogen or more, is recirculated to the reactors. The liquids from the first phase-separation section are passed to a second phase-separation section, where the pressure is lowered, thereby flashing off a light hydrocarbon stream, which is typically sent to the fuel gas line. The liquids from the separators are sent for fractionation, or to another destination as appropriate.

The processes of the invention differ from these prior art processes in that they include a membrane separation step to provide selective purging of the reactor loop. The invention includes three steps, therefore: hydroprocessing, separation of the hydroprocessor effluent into vapor and liquid phases, and membrane separation treatment of the vapor phase.

As stated above, it is preferred to carry out the membrane separation treatment on the overhead vapors from the first phase-separation section, where the vapor remains at high pressure and, as in prior art reactors, is recirculated, at least in part, to the reactor. Thus, for ease of understanding, much of the detailed description that follows is focused on this embodiment. When these teachings have been understood, those of skill in the art will be able to apply them to treatment of other overhead vapors, such as those from the low-pressure flash section, from which hydrogen is usually not recirculated to the reactors.

A basic embodiment of the invention is shown in FIG. 1. It will be appreciated by those of skill in the art that this, and the other figures described below, are very simple schematic diagrams. These are intended to make clear the essential elements of the invention, and in particular the manner in which the membrane separation step is included. Those of skill in the art will appreciate that a hydroprocessing train will usually include many additional components of a standard type, such as heaters, chillers, condensers, pumps, blowers, other types of separation and/or fractionation equipment, valves, switches, controllers, pressure-, temperature, level- and flow-measuring devices and the like.

Referring to FIG. 1, box 101 represents the hydroprocessing reactor or reactors. The reactors may be single-stage or multi-stage reactors, may be of any type and may perform any reaction, within the limits of the invention; that is, the reactor feed contains at least hydrogen and a hydrocarbon, and the reactor effluent also contains hydrogen and a hydrocarbon, but in a different composition. Hydroprocessing reactors are well known in the art and do not require any lengthy description herein. References that provide discussion of design and operation of modern reactors include Chapters 7 and 8 of "Handbook of Petroleum Refining Processes" Second Edition, R. A. Meyers (Ed), McGraw Hill, 1997, and U.S. Pat. Nos. 4,362,613 and 4,367,135, relevant sections of which are incorporated herein by reference. FIG. 1 shows three feed streams—102, the fresh hydrogen stream; 103, the hydrocarbon stream; and 110, the recycle stream—entering the reactor. The hydrogen feed gas is provided in an amount sufficient to effect the desired hydroprocessing reactions and to maintain a high hydrogen partial pressure to protect the catalyst. Usually, the amount of hydrogen provided to the hydroprocessing zone must be substantially greater than the amount consumed in the hydroprocessing reaction. The hydrogen feed gas should contain at least about 75 volume %, more preferably at least about 80 volume % hydrogen.

Commonly, streams 102, 103 and 110 will be combined as shown and passed through compressors, heat exchangers or direct-fired heaters (not shown) to bring them to the appropriate reaction conditions before entering the reactors. Alternatively, the streams can be prepared and fed separately to the reactor. Commonly, the hydrocarbon stream, 103, itself may be a combination of recycled unreacted hydrocarbons and fresh feed.

One or multiple reactors can be used in the process, with the individual reactors carrying out the same or different unit operations. The reactor operating conditions are not critical to the invention, and can and will vary over a wide range, depending on the function of the reactor. For example, the first stage of a typical two-stage reactor section operates at 2,000–3000 psig, 350–450° C. and consumes 6,000–9,000 scf of hydrogen per barrel of hydrocarbon feedstock; the second stage typically may operate at 1,500–2,000 psig, 280–400° C. and consumes 5,000–7,000 scf of hydrogen per barrel of feedstock. However, these ranges are given only by way of guidelines for typical processes and the invention embraces all reactor temperature, pressure and other conditions.

The raw effluent stream, 104, is withdrawn from the reactor section. The temperature and pressure of the hydroprocessing zone are usually such that the raw hydrocrackate is a two-phase mixture. The first treatment step required is to separate the effluent stream into discrete liquid and gas phases, shown as streams 106 (liquid) and 107 (vapor) in FIG. 1. This separation step involves cooling the raw effluent, typically to below 100° C. and preferably to below 70° C., to partition the hydrocarbons in the stream into the liquid phase. This step is indicated simply as box 105, although it will be appreciated that it can be executed in one or multiple sub-steps. For example, the effluent from a hydrocracker may be at 350° C. and may be reduced in temperature in three stages to 50° C. In this case, the vapor phase from the first sub-step forms the feed to the second sub-step, and so on. The cooling step or steps can be performed by heat exchange against other plant streams, and/or by using air cooling, water cooling or refrigerants, depending on availability and the desired final temperature. Such techniques are familiar to those of skill in the art. Air cooling, optionally combined with heat exchange, is preferred. It is preferred to maintain the effluent at high pressure, such as at or close to the pressure of the last reactor, during this phase separation step to minimize recompression requirements.

The cooling steps promote condensation of the heavier hydrocarbons, which are withdrawn as a liquid phase (stream 106). This liquid phase is withdrawn and passed to downstream treatment, appropriate to its ultimate destination, typically, but not necessarily, including stabilization by flashing off light components and then fractionation. Some hydroprocessed streams form feedstocks to other refinery operations, such as catalytic reforming.

Overhead vapor stream 107 passes as feed to the membrane selective purge step, 108. For ease of understanding the invention, FIG. 1 shows the simplest case in which the entirety of the vapor phase passes to the membrane purge step, 108. However, dashed arrow 111 is intended to indicate that a portion only of the vapor phase may pass to the membrane separation step, and another portion may be withdrawn from the loop as a supplementary unselective purge, and/or for other treatment.

The membrane unit contains a membrane that exhibits a substantially different permeability for hydrocarbons than for hydrogen. The permeability of a gas or vapor through a membrane is a product of the diffusion coefficient, D, and the Henry's law sorption coefficient, k. D is a measure of the permeant's mobility in the polymer; k is a measure of the permeant's sorption into the polymer. The diffusion coefficient tends to decrease as the molecular size of the permeant increases, because large molecules interact with more segments of the polymer chains and are thus less mobile. The sorption coefficient depends, amongst other factors, on the condensability of the gas.

Depending on the nature of the polymer, either the diffusion or the sorption component of the permeability may dominate. In rigid, glassy polymer materials, the diffusion coefficient tends to be the controlling factor and the ability of molecules to permeate is very size dependent. As a result, glassy membranes tend to permeate small, low-boiling molecules, such as hydrogen and methane, faster than larger, more condensable molecules, such as $C_{2+}$ organic molecules. For rubbery or elastomeric polymers, the difference in size is much less critical, because the polymer chains can be flexed, and sorption effects generally dominate the permeability. Elastomeric materials, therefore, tend to permeate large, condensable molecules faster than small, low-boiling molecules. Thus, most rubbery materials are selective in favor of all $C_{3+}$ hydrocarbons over hydrogen. However, for the smallest, least condensable hydrocarbons, methane in particular, even rubbery polymers tend to be selective in favor of hydrogen, because of the relative ease with which the hydrogen molecule can diffuse through most materials. For example, neoprene rubber has a selectivity for hydrogen over methane of about 4, natural rubber a selectivity for hydrogen over methane of about 1.6, and Kraton, a commercial polystyrene-butadiene copolymer, has a selectivity for hydrogen over methane of about 2.

Any rubbery material that is selective for $C_{2+}$ hydrocarbons over hydrogen will provide selective purging of these components and can be used in the invention. Examples of polymers that can be used to make such elastomeric membranes, include, but are not limited to, nitrile rubber, neoprene, polydimethylsiloxane (silicone rubber), chlorosulfonated polyethylene, polysilicone-carbonate copolymers, fluoroelastomers, plasticized polyvinylchloride, polyurethane, cis-polybutadiene, cis-polyisoprene, poly(butene-1), polystyrene-butadiene copolymers, styrene/butadiene/styrene block copolymers, styrene/ethylene/butylene block copolymers, and thermoplastic polyolefin elastomers.

However, the preferred membrane used in the present invention differs from other membranes used in the past in refinery and petrochemical processing applications in that it is more permeable to all hydrocarbons, including methane, than it is to hydrogen. In other words, unlike almost all other membranes, rubbery or glassy, the membrane is methane/hydrogen selective, that is, hydrogen rejecting, so that the permeate stream is hydrogen depleted and the residue stream is hydrogen enriched, compared with the membrane feed stream. To applicants' knowledge, among the polymeric membranes that perform gas separation based on the solution/diffusion mechanism, silicone rubber is the only material that is selective in favor of methane over hydrogen. As will now be appreciated by those of skill in the art, at least some of the benefits that accrue from the invention derive from the use of a membrane that is both polymeric and hydrogen rejecting. Thus, any polymeric membrane that is found to have a methane/hydrogen selectivity greater than 1 can be used for the processes disclosed herein and is within the scope of the invention. For example, other materials that might perhaps be found by appropriate experimentation to be methane/hydrogen selective include other polysiloxanes.

Another class of polymer materials that has at least a few members that should be methane/hydrogen selective, at least in multicomponent mixtures including other more condensable hydrocarbons, is the superglassy polymers, such as poly(1-trimethylsilyl-1-propyne) [PTMSP] and poly(4-methyl-2-pentyne) [PMP]. These differ from other polymeric membranes in that they do not separate component gases by solution/diffusion through the polymer. Rather, gas transport is believed to occur based on preferential sorption and diffusion on the surfaces of interconnected, comparatively long-lasting free-volume elements. Membranes and modules made from these polymers are less well developed to date; this class of materials is, therefore, less preferred than silicone rubber.

A third type of membrane that may be used if hydrogen sulfide is a significant contaminant of the stream is one in which the selective layer is a polyamide-polyether block copolymers having the general formula

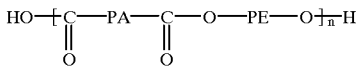

where PA is a polyamide segment, PE is a polyether segment and n is a positive integer. Such polymers are available commercially as Pebax® (Atochem Inc., Glen Rock, N.J.) or as Vestamid® (Nuodex Inc., Piscataway, N.J.). These types of materials are described in detail in U.S. Pat. No. 4,963,165, for example. Such membranes will remove hydrogen sulfide with a very high selectivity, such as 20 or more, for hydrogen sulfide over hydrogen. They are, however, selective in favor of hydrogen over methane, with a selectivity of about 1 to 2, depending on grade, so are not preferred where methane build up in the loop is the greatest concern.

The membrane may take the form of a homogeneous film, an integral asymmetric membrane, a multilayer composite membrane, a membrane incorporating a gel or liquid layer or particulates, or any other form known in the art. The preferred form is a composite membrane including a ricroporous support layer for mechanical strength and a rubbery coating layer that is responsible for the separation properties.

The membranes may be manufactured as flat sheets or as fibers, and may be housed in any convenient module form, including spiral-wound modules, plate-and-frame modules and potted hollow-fiber modules. The making of all these types of membranes and modules is well known in the art. Flat-sheet membranes in spiral-wound modules are our most preferred choice. The preferred form is a composite membrane including a microporous support layer for mechanical strength and a silicone rubber coating layer that is responsible for the separation properties. Additional layers may be included in the structure as desired, such as to provide strength, protect the selective layer from abrasion, and so on.

A benefit of using silicone rubber or superglassy membranes is that they provide much higher transmembrane fluxes than conventional glassy membranes. For example, the permeability of silicone rubber to methane is 800 Barrer, compared with a permeability of only less than 10 Barrer for 6FDA polyimide or cellulose acetate.

To achieve a high flux of the preferentially permeating component, the membrane layer responsible for the separation properties should be thin, preferably, but not necessarily, no more than 30 μm thick, more preferably no more than 20 μm thick, and most preferably no more than 5 μm thick. If super-glassy membranes are used, the membranes may be thicker, such as 50 μm thick or even substantially more, such as 100 μm or more, because these membranes have extraordinarily high transmembrane fluxes.

A driving force for transmembrane permeation is provided by a pressure difference between the feed and permeate sides of the membrane. As mentioned above, the reactors generally run at high pressure, such as above 1,500 psig, and the first phase-separation step is carried out at high pressure, such as above 1,000 psig. Thus, the feed to the membrane unit is usually at a very high pressure, so no additional compressors or other pieces of rotating equipment are required to operate the membrane purging step. The recycle stream remains at or close to the pressure of the separator overhead, subject only to a slight pressure drop along the feed surface of the membrane modules, and can, therefore, be sent to a recycle booster compressor, as necessary, of essentially the same capacity as would have been required in the prior art system. If the pressure of the membrane feed stream is insufficient to provide adequate driving force for whatever reason, a compressor may be included in the feed line between the phase separation step and the membrane separation step to boost the feed gas pressure.

Since polymeric materials are used for the membranes, they are relatively easy and inexpensive to prepare and to house in modules, compared with other types of hydrogen-rejecting membranes, such as finely microporous inorganic membranes, including adsorbent carbon membranes, pyrolysed carbon membranes and ceramic membranes.

Depending on the composition of the membrane feed stream 107, a single-stage membrane separation operation may be adequate to produce a permeate stream with an acceptably high contaminant content and low hydrogen content. If the permeate stream requires further separation, it may be passed to a second bank of modules for a second-stage treatment. If the second permeate stream requires further purification, it may be passed to a third bank of modules for a third processing step, and so on. Likewise, if the residue stream requires further contaminant removal, it may be passed to a second bank of modules for a second-step treatment, and so on.. Such multistage or multistep processes, and variants thereof, will be familiar to those of skill in the art, who will appreciate that the membrane separation step may be configured in many possible ways, including single-stage, multistage, multistep, or more complicated arrays of two or more units in series or cascade arrangements. Representative embodiments of a few of such arrangements are given in copending Ser. No. 09/083,660 entitled "Selective Purge for Reactor Recycle Loop". Examples of such arrangements are also described in U.S. Pat. No. 5,256,295.

Membrane residue stream 110, is enriched in hydrogen and depleted of hydrocarbons, hydrogen sulfide and other contaminants, and is recirculated, in whole or in part, to the reactor. An advantage of using a hydrogen-rejecting membrane is that the stream that is recirculated in the reactor loop remains on the high-pressure side of the membrane. This reduces recompression requirements, compared with the situation that would obtain if a hydrogen-selective membrane were to be used. In that case, the permeate stream might be at only 10% or 20% the pressure of the feed, and would need substantial recompression before it could be returned to the reactor. As mentioned above, an optional booster compressor, not shown, is often used to bring the return stream up to the pressure of the first reactor in the reactor section.

Optionally, all or part of the residue stream may be subjected to additional treatment, to increase the hydrogen concentration yet more or to remove specific contaminants. For example, if the overhead vapor from the phase separator is heavily contaminated with hydrogen sulfide, the membrane unit may provide adequate purging of light hydrocarbons, but may result in a residue stream still containing more hydrogen sulfide than can be returned to the reactors. The stream then pass through a scrubbing step or the like, as is known in the art, to reduce the acid gas content before it is returned to the reactor. Use of the membrane unit upstream of the scrubbing system then reduces the amount of gas that has to be processed by the scrubbing unit. If a higher concentration of hydrogen is required, the gas can be passed to a pressure swing adsorption (PSA) unit for upgrading, although this is seldom necessary, and is not preferred, for the parts of the residue stream that return to the reactor.

The permeate stream, containing the hydrocarbons, hydrogen sulfide, and other contaminants, which may include but are not limited to carbon monoxide, carbon dioxide, nitrogen, ammonia, and water vapor, is withdrawn as stream 109. This stream may be used as fuel gas within the facility. Alternatively, the stream may be treated for further recovery of sulfur or NGL. If the stream is sufficiently concentrated in hydrogen sulfide, it may be passed to a Claus plant for conversion to sulfur. If the stream is of low concentration, it may be treated by some other process, such as a redox process. Further treatment for recovery of NGL may be accomplished by compression and condensation and/or by additional membrane treatment, for example.

Those of skill in the art will appreciate that the membrane area and membrane separation step operating conditions can be varied depending on whether the component of most interest to be enriched in the permeate is methane, ethane, a $C_{3+}$ hydrocarbon, hydrogen sulfide or some other material. For example, the concentration of propane might be raised from 2 vol % in the feed to 10 vol % in the permeate, or the hydrogen sulfide concentration might be raised from 1% to 5%. Correspondingly, the hydrogen content might be diminished from 75 vol % in the feed to 50 vol % in the permeate.

This capability can be used to advantage in several ways. In one aspect, the mass of a specific contaminant purged from the reactor recycle loop can be controlled. Suppose reactor conditions and flow rates are such that it is necessary, by whatever means, to remove 2,500 lb/h of total hydrocarbons from the reactor loop. Without the membrane separation step, this level of removal might result in the purging and loss of 600 lb/h of hydrogen. By purging the permeate stream, a flow of 2,500 lb/h of hydrocarbons can be removed by purging only 350 lb/h of hydrogen. This has two immediate benefits. On the one hand, the purge stream is much more concentrated in hydrocarbons than would have been the case if an unselective purge had been carried out. This facilitates further separation and recovery of the hydrocarbons downstream. On the other hand, the hydrogen loss with the purge is reduced, in favorable cases to half or less of what it would be if unselective purging were practiced.

In another aspect, the process can provide a lower level of contaminants in the reactor. Suppose it is desired to operate the reactor at the lowest practical hydrogen sulfide content in the reactor gas mix, while maintaining hydrogen recovery from the vapor stream at 50%. Absent the membrane separation step, this would be accomplished by dividing stream 107 in half, directing one half to the purge, the other back to the reactor. Suppose this had the effect of returning 400 lb/h of hydrogen sulfide to the reactor and purging 400 lb/h of hydrogen sulfide. By passing the purge stream through the membrane separation unit, however, a permeate purge stream is created that has less hydrogen per unit of hydrogen sulfide than was present in the feed. In this case, loss of 50% hydrogen into the permeate purge is accompanied by a higher loss of hydrogen sulfide, say 600 lb/h in the permeate stream. Thus, the hydrogen recovery can be maintained at the desired level, but results in a lesser amount of hydrogen sulfide per pass (only 200 lb/h) being returned to the reactor mix. This provides a mechanism for improving the reactor conditions, and may enable the feed throughput of the reactor to be increased, and/or the cycle time to be extended.

In yet another aspect, by selectively removing the non-hydrogen components, the process results in a membrane residue stream, 110, that is enriched in hydrogen content compared with stream 107. Of course, if desired, the membrane separation unit can be configured and operated to provide a residue stream that has a significantly higher hydrogen concentration compared with the feed, such as 90 vol %, 95 vol % or more, subject only to the presence of any other slow-permeating component, such as nitrogen, in the feed. This can be accomplished by increasing the stage-cut of the membrane separation step, that is, the ratio of permeate flow to feed flow, to the point that little of anything except hydrogen is left in the residue stream. As the stage-cut is raised, however, the purge becomes progressively less selective. This can be clearly seen by considering that, in the limit, if the stage-cut were allowed to go to 100%, all of the gas present in the feed would pass to the permeate side of the membrane and the purge would become completely unselective. Since the purpose of the invention is to control or diminish loss of hydrogen by selective purging, a very high stage-cut, and hence a high hydrogen concentration in the residue, defeats the purpose of the invention. It is preferred, therefore, to keep the stage-cut low, such as below 50%, more preferably below 40% and most preferably below 30%. Those of skill in the art will appreciate that within these guidelines, the stage-cut can be chosen to meet the desired purging objectives, in terms of hydrogen loss and contaminant removal. Typically, it is possible, as illustrated in the examples section below, to reduce the hydrogen concentration of the permeate, compared with the hydrogen concentration in the feed, by at least about 1.5 times, 2 times, and sometimes by as much as 5 times, 10 times or much more.

Based on the above considerations, the residue stream, 110, will be enriched in hydrogen compared with the feed. However, the hydrogen concentration will be only slightly higher than the feed, such as no more than about 1%, 2% or 5% higher. This in turn will lead to a slightly higher hydrogen partial pressure in the reactor. Even though this partial pressure increase is comparatively small, it may be beneficial in improving desired product yield and prolonging catalyst life.

FIG. 1 shows the membrane unit installed directly in the reactor recycle line. An optional, but particularly preferred, variant of the basic arrangement of FIG. 1 is to install the membrane unit in a side-loop, in other words maintain a bypass line around the membrane separation section, as indicated by dashed line 112. Valves can be included in the lines so that at least a portion of the light hydrocarbon vapor stream can bypass the membrane separation step, either during normal operation or intermittently. This enables the membrane unit to be taken off-line, for maintenance or the like, without the necessity of shutting down the hydroprocessing reactor or the subsequent downstream processes. Temporarily switching out the membrane unit from the process train will, of course, alter process and product characteristics to some extent, but is preferable to a full shutdown of the reactors.

Figure 2:
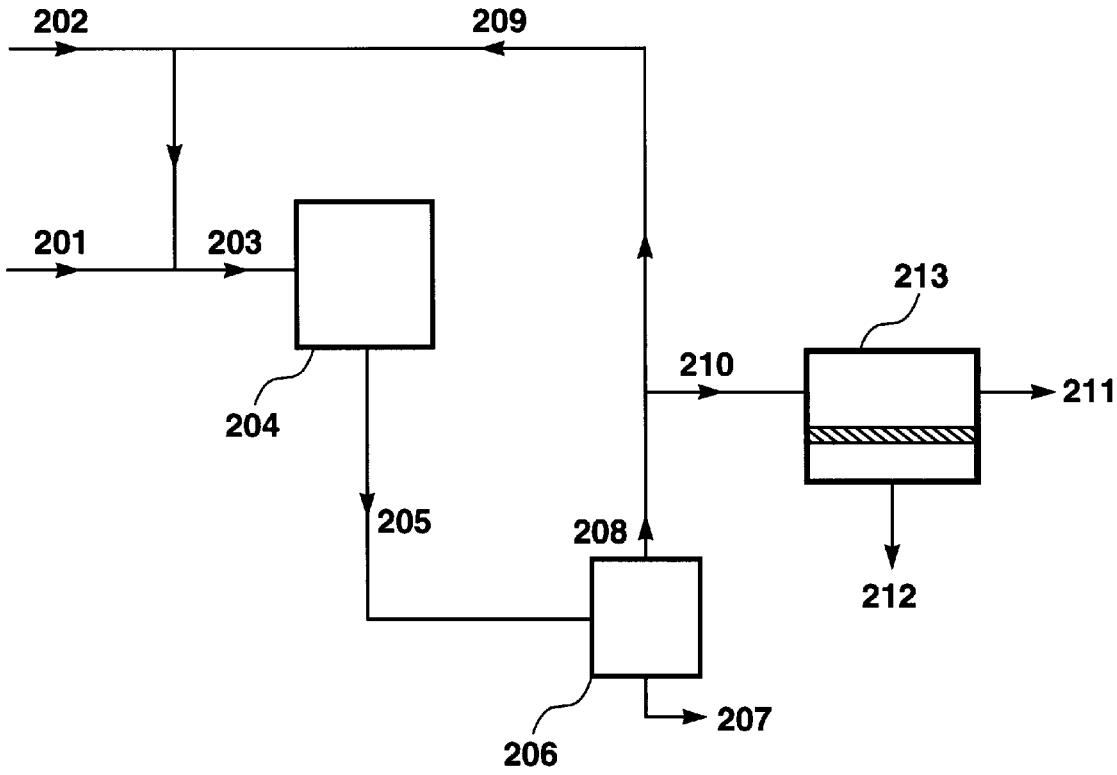
FIG. 2 is a schematic drawing showing an embodiment of the invention in which the membrane separation unit treats the purge stream.

FIG. 2 shows an embodiment of the invention in which the membrane separation unit treats the purge stream, and in which the residue stream may or may not be recirculated to the reactor. Embodiments of this type can be used conveniently, for example, to retrofit a prior art system by adding the membrane separation unit and optionally the other components in an existing purge line, enabling components of value to be recovered from what was previously a waste gas stream. All of the considerations, preferences and other features discussed above with respect to the embodiment of FIG. 1 apply also to the embodiment of FIG. 2 and to the other figures herein, except as explicitly described otherwise.

Referring now to FIG. 2, box 204 represents the reactor, which may be of any type as described with respect to FIG. 1. Streams 201, the hydrocarbon stream; 202, the fresh hydrogen stream; and 209, the recycle stream, are combined to form stream 203. This stream is brought to the desired conditions and passed into the reactor. Effluent stream 205 is withdrawn and enters phase separation step 206, which can be executed in any convenient manner, as described for FIG. 1 above. Liquid phase, 207, is withdrawn. Vapor phase, 208, is divided into two streams: stream 209, which is recirculated to the reactor, and stream 210, a purge stream, which is passed to membrane separation unit 213.

As with the embodiment of FIG. 1, the membrane separation step makes a hydrogen/hydrocarbon separation. By selectively removing the non-hydrogen components, the process results in a membrane residue stream, 211, that is enriched in hydrogen content compared with stream 210. Of course, if desired, the membrane separation unit can be configured and operated to provide a residue stream that has a significantly higher hydrogen concentration compared with the feed, such as 90 vol %, 95 vol % or more, subject only to the presence of any other slow-permeating component, such as nitrogen, in the feed. This can be accomplished by increasing the stage-cut of the membrane separation step, that is, the ratio of permeate flow to feed flow, to the point that little of anything except hydrogen is left in the residue stream. As the stage-cut is raised, however, more hydrogen is lost into the permeate stream. This can be clearly seen by considering that, in the limit, if the stage-cut were allowed to go to 100%, all of the gas present in the feed would pass to the permeate side of the membrane and no separation would take place.

Conversely, if a very low stage-cut is used, a permeate stream with a high concentration of $C_{3+}$ hydrocarbons can be obtained, but a significant fraction of the heavier hydrocarbons will remain in the residue stream. Those of skill in the art will appreciate that the membrane area and membrane separation step operating conditions can be chosen depending on whether the composition of the permeate or the residue stream is of more importance in terms of the recovery goals. For example, the concentration of $C_{3+}$ hydrocarbons might be raised from 5 vol % in the feed to about 30 vol % in the permeate. Correspondingly, the hydrogen content might be diminished from 80 vol % in the feed to about 45 vol % in the permeate. Alternatively, the hydrogen concentration might be raised from 80 vol % in the feed to 90 vol % in the residue, with a corresponding drop in $C_{3+}$ hydrocarbons from 15 vol % in the feed to 8 vol % in the residue.

The unit produces permeate stream 212, which is enriched in contaminants and hydrocarbons and depleted in hydrogen. This stream can be recompressed, if necessary, and sent to any desired destination, such as for use as LPG or for further fractionation. Passing this stream to the low-pressure separator section of the plant, for example, will increase liquids recovery there.

Membrane residue stream 211, may be sent to the fuel gas line, used without further treatment as a hydrogen source, such as by returning to the reactor, 204, or subjected to additional treatment, as desired. Preferred additional treatments include further membrane separation, this time using a hydrogen-selective membrane, and pressure swing adsorption (PSA). An advantage of using a hydrogen-rejecting membrane for step 213 is that the hydrogen-enriched stream remains on the high-pressure side of the membrane. This greatly facilitates further treatment. For example, if the further treatment is hydrogen-selective membrane separation, the residue stream, 211, can, optionally, be passed directly to this step without recompression. Likewise if the treatment is PSA, it is often possible to operate the system at or below the pressure of residue stream 211. In contrast, if a hydrogen-selective membrane were to be used for step 211, the permeate stream might be at only 10% or 20% the pressure of the feed, and would need substantial recompression before it could be subjected to further treatment. More details concerning combinations of a hydrocarbon-selective membrane unit with a hydrogen-selective membrane unit or with a PSA unit may be found in U.S. Pat. No. 6,011,192 entitled "Membrane-Based Conditioning For Adsorption System Feed Gases".

Figure 3:
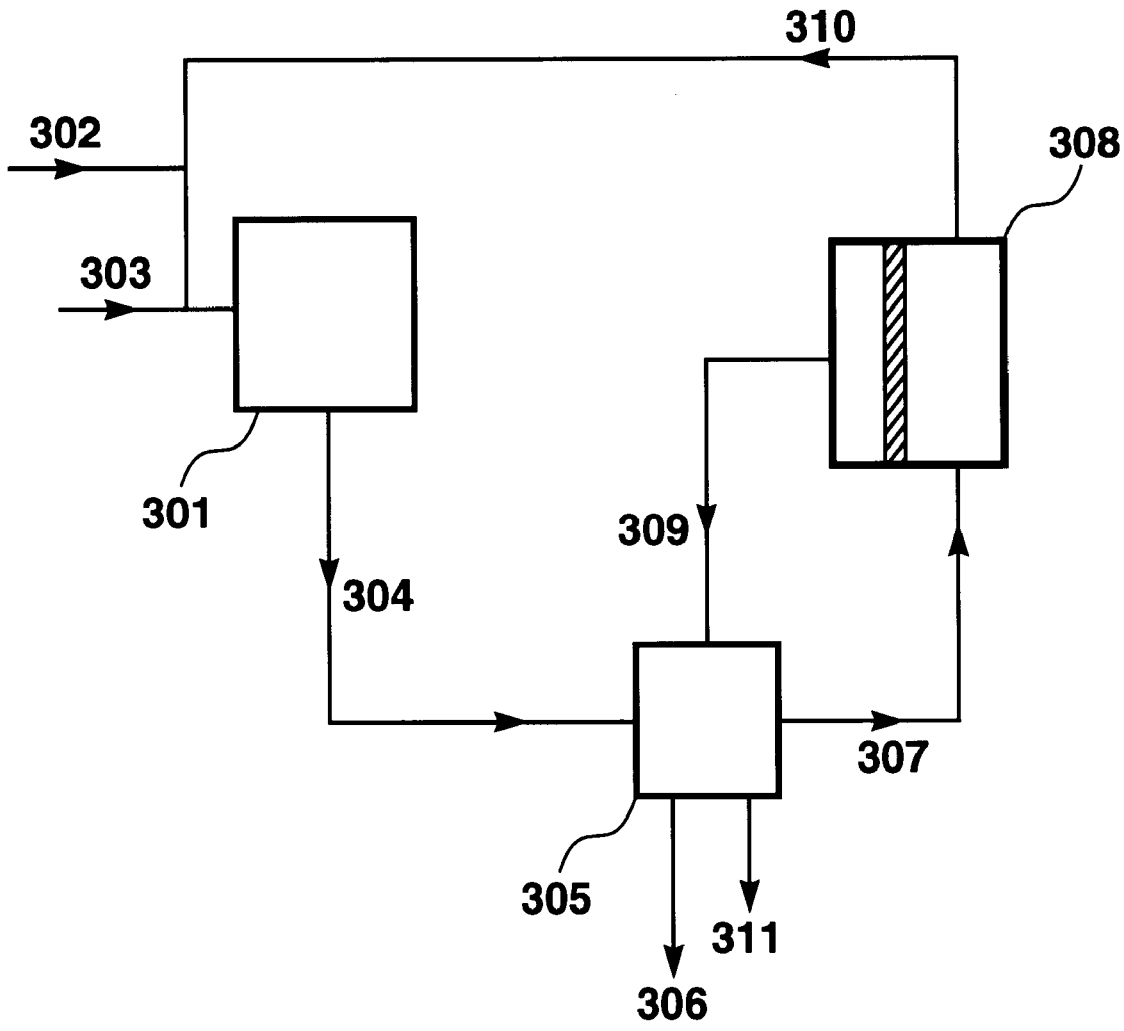
FIG. 3 is a schematic drawing showing an embodiment of the invention in which the membrane permeate stream is recirculated within the phase separator loop.

FIG. 3 shows an embodiment in which the membrane permeate stream is not removed from the loop directly, but is passed back to the phase separation step and withdrawn there. Such an embodiment is useful, for example, but not only, when hydrogen sulfide is the principal contaminant of concern. Describing the figure by way of this illustration, reactor 301 is a hydrodesulfurization unit operating on some cut from the atmospheric or vacuum distillation columns.

Figure 5:
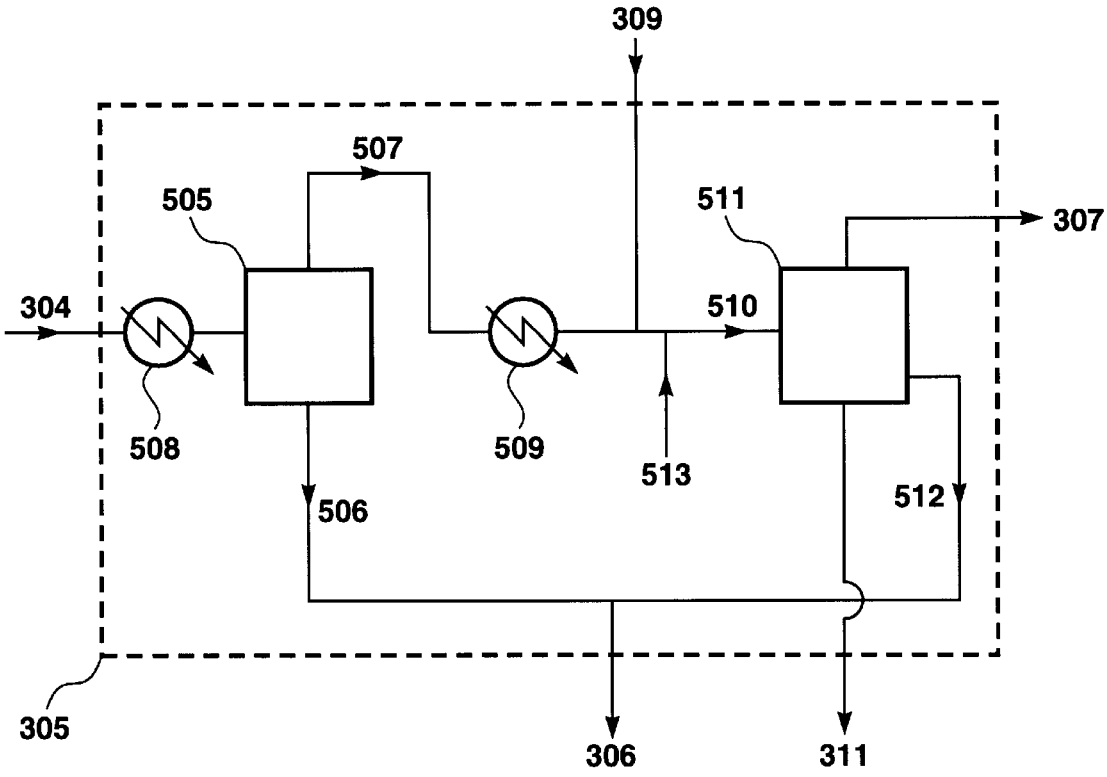
FIG. 5 is a schematic drawing showing an embodiment of the phase separation step of FIG. 3 in more detail.

Streams 303, the sulfur-laden feed; 302, the fresh hydrogen stream; and 310, the recycle stream are brought to the desired conditions and passed into the reactor. Effluent stream 304 contains hydrogen sulfide that has been formed in the reactor, in addition to hydrocarbons and other materials, depending on the source of the feed and the specifics of the reaction. This stream passes into phase separation step 305. FIG. 5 shows the phase separation step 305, indicated overall by the dashed line, broken down in more detail, as might be appropriate to the hydrodesulfurization case. Stream 304 is cooled, 508, by heat exchange or otherwise, and passes into first, high temperature separator, 505, yielding liquid stream 506 and vapor stream 507. Vapor stream 507 is cooled, 509, to a lower temperature and is mixed with permeate purge stream 309 from the membrane separation step. The stream is washed by introducing water stream, 513 and passes as stream 510 into low temperature separator 511. This is a three-phase separator of any type, as well known in the art. Hydrogen sulfide contained in the stream is readily dissolved in the water that has been introduced, as is ammonia, which is often present as an additional contaminant. The resulting sour water stream is withdrawn as purge stream 311. The organic liquid phase from the separator is withdrawn as stream 512, and combined with the organic liquid from the high temperature separator to form organic liquid phase 306. The vapor phase, 307, is withdrawn from the low temperature separator.

Returning to FIG. 3, stream 307, containing any hydrogen sulfide that was not captured by the water wash, passes into membrane separation step, 308. In this case, it is optional, but preferred, to use a polyamide-polyether block copolymer as the selective membrane material. The membrane permeates hydrogen sulfide, hydrocarbons and ammonia faster than hydrogen, yielding a permeate purge stream, 309, that is selectively enriched in acid gas and hydrocarbons. This stream is then passed back to the phase separation step as already discussed and shown in FIG. 5. In this manner, two particular benefits are obtained: one, the membrane provides additional selective purging of the hydrogen sulfide, and two, the recovery of liquid hydrocarbons is increased. The membrane residue stream, 310, is recirculated to the inlet of the reactor.

It will be appreciated that the configuration of FIG. 3 can also be used for removal of contaminants other than hydrogen sulfide, for example, carbon dioxide, ammonia or specific hydrocarbons, and can involve other separation techniques than water scrubbing, for example amine absorption, lean oil absorption or stripping.

Figure 4:
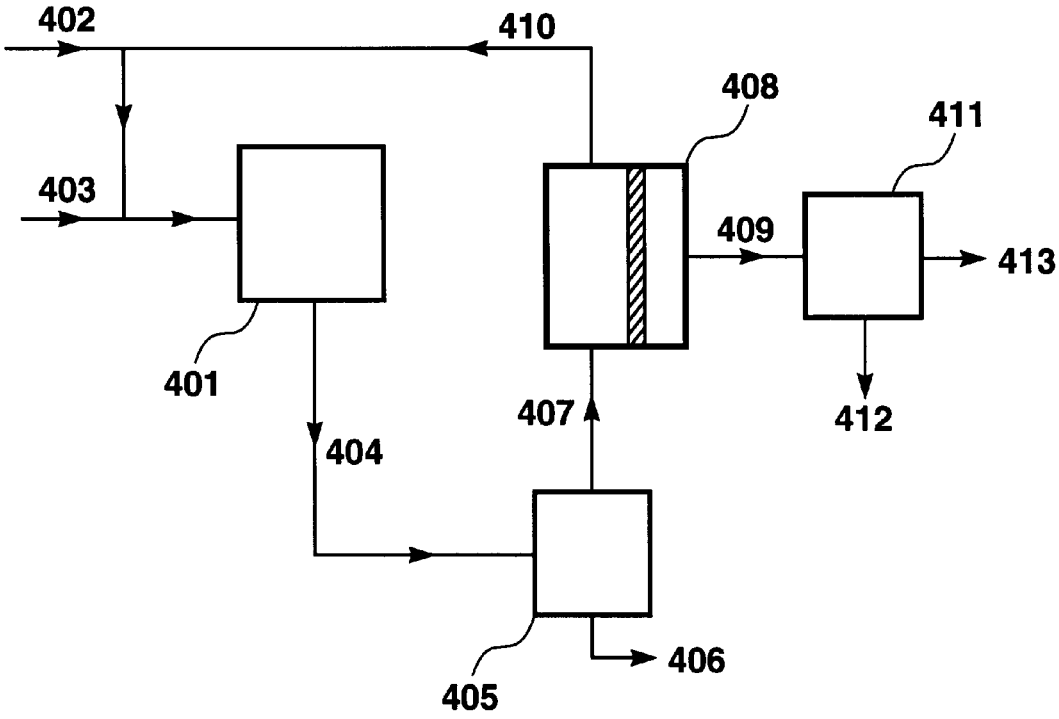
FIG. 4 is a schematic drawing showing an embodiment of the invention in which the membrane permeate stream is subjected to additional treatment.

FIG. 4 shows an embodiment in which the permeate purge stream is subjected to further treatment. In this case, box 401 represents the hydroprocessor. Streams 402, the fresh hydrogen stream; 403, the hydrocarbon stream; and 410, the recycle stream are brought to the desired conditions and passed into the reactor. Effluent stream 404 is withdrawn and enters phase separation step 405. A liquid phase, 406, is withdrawn. The vapor phase, 407, passes to the membrane separation step, 408, and is separated into permeate purge stream 409, enriched in contaminants and depleted in hydrogen, and residue stream 410, which is recirculated. Permeate stream 409 passes into additional treatment step 411. This step may take diverse forms, depending on the content of stream 409 and the environment of use, and could be, by way of non-limiting examples: absorption, such as into water, amine solution or hydrocarbon liquid; adsorption, such as pressure swing adsorption; distillation, including fractionation into multiple components and splitting into a top and bottom product; stripping, such as by steam or light hydrocarbons; flashing; and membrane separation, using similar or dissimilar membranes to those used in the membrane separation step.

Since the permeate stream is particularly enriched in the heavier hydrocarbon components of stream 407, it can be added to liquid stream 406 from the phase separation step, thereby increasing the liquids recovery. In hydrocracking, the liquids from the phase separators are sometimes passed through a steam stripper to remove light components before passing the oil into a fractionator. Stream 409 can be added to the feed to the steam stripper in this case.

Figure 7:
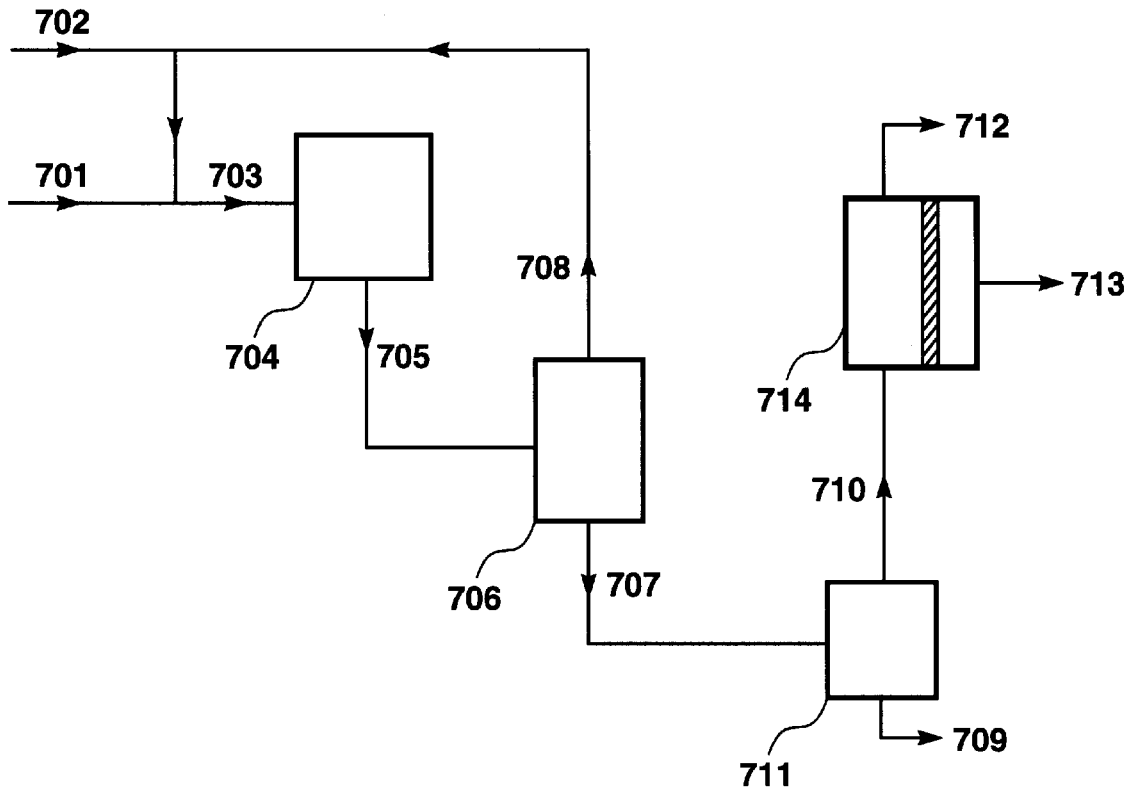
FIG. 7 is a schematic drawing showing an embodiment of the invention in which the vapor stream from a second, low-pressure separator is subjected to membrane treatment.

The description of the invention so far has focused on embodiments that involve treatment of vapor from the high-pressure separator section. FIG. 7 shows a representative embodiment of the invention in which the vapor stream from the low-pressure separator section is subjected to membrane treatment. In this figure, box 704 represents the reactor, which may be of any type as described with respect to FIG. 1. Streams 701, the hydrocarbon stream; 702, the fresh hydrogen stream; and 708, the recycle stream, are combined to form stream 703. This stream is brought to the desired conditions and passed into the reactor. Effluent stream 705 is withdrawn and enters high-pressure phase separation step 706, which can be executed in any convenient manner, as described for FIG. 1 above. Vapor phase, 708, is recirculated without further separation to the reactor. Liquid phase, 707, contains substantial amounts of dissolved hydrogen and light hydrocarbon gases. This stream is let down in pressure and passed to low-pressure phase-separation step 711, where light components are flashed. The degree of light component removal obtained depends on the pressure. Preferably, the pressure is reduced to about half that of the high-pressure phase-separation step. For example, if the high-pressure phase separation step is performed at 1,000 psig, the low pressure step is preferably performed at about 500 psig.

The stabilized liquid phase is withdrawn as stream 709; the vapor phase, 710, after additional recompression, if necessary, is passed to membrane separation unit 714. This unit produces permeate stream 713, which is enriched in contaminants and hydrocarbons and depleted in hydrogen and residue stream 712, enriched in hydrogen and depleted in hydrocarbons. The operating conditions of membrane unit 714, in terms of desired compositions of streams 712 and 713, as well as destinations for those streams, are generally the same as described above with respect to FIG. 2.

The invention includes apparatus for performing the hydroprocessing operation according to the diverse possibilities, such as using combinations and connections of separators, compressors, condensers, membrane units, and so on as shown in the Figures. For example, in FIG. 1, the apparatus comprises a reactor, 101, with a hydrocarbon feed inlet, 103, a hydrogen feed inlet, 102, and an effluent outlet line, 104, connecting to an inlet of phase separator, 105. The phase separator has a liquid outlet, 106, and a vapor outlet line, 107, connected to an inlet on the feed side of membrane separation unit, 108. The membrane separation unit has a permeate side outlet line 109, and a feed side outlet line, 110, connected to the hydrogen feed inlet. Optional line 111 allows a portion of the vapor stream to be non-selectively purged, if desired. Optional line 112 allows a portion of the vapor stream to be returned to the reactor without passing through the membrane separation unit.

Those of skill in the art will appreciate that the apparatus used to carry out the process will, of course, include other components, such as, for example, pumps, blowers, coolers, heaters, condensers, compressors, vacuum pumps, or valves as desired, some of which are shown in FIGS. 2–7.

The invention is now further illustrated by the following examples, which are intended to be illustrative of the invention, but are not intended to limit the scope or underlying principles of the invention in any way.

EXAMPLE 1–3

Comparative calculations were carried out to contrast the performance of the invention with prior art unselective purging. The calculations were performed using a modeling program, ChemCad III (ChemStations, Inc., Houston, Tex.), to simulate the treatment of a typical off-gas stream from a phase separator of a hydrocracker process.

The off-gas stream from the phase separator was assumed to have a flow rate of 50 MMscfd, to be at a temperature of 50° C. and a pressure of 1,800 psia, and have the following composition:

| | |
|---|---|
| Hydrogen | 74.5% |
| Methane | 17.5% |
| Ethane | 6.5% |
| Propane | 1.5% |

EXAMPLE 1

Not in Accordance with the Invention

The prior art process was assumed to be carried out simply by withdrawing 8%, or 4 MMscfd, of gas from the separator overhead, and recirculating the remaining 46 MMscfd to the reactor. The compositions of the purge gas and recycle gas streams are, of course, the same in the unselective purge process. The results of the calculations are shown in Table 1.

TABLE 1

| Component / Parameter | Separator Off-Gas | Recycle Stream | Purge Stream |
|---|---|---|---|
| Molar Flow Rate (lbmol/h) | 5,803 | 5,338 | 464 |
| Mass Flow Rate (lb/h) | 40,185 | 36,970 | 3,215 |

TABLE 1-continued

| Component / Parameter | Separator Off-Gas | Recycle Stream | Purge Stream |
|---|---|---|---|
| Temperature (° C.) | 50 | 50 | 50 |
| Pressure (psia) | 1,800 | 1,800 | 1,800 |
| Component (mol %) | | | |
| Hydrogen | 74.5 | 74.5 | 74.5 |
| Methane | 17.5 | 17.5 | 17.5 |
| Ethane | 6.5 | 6.5 | 6.5 |
| Propane | 1.5 | 1.5 | 1.5 |
| Component (lb/h) | | | |
| Hydrogen | 8,714 | 8,017 | 697 |
| Methane | 16,291 | 14,988 | 1,302 |
| Ethane | 11,342 | 10,434 | 907 |
| Propane | 3,838 | 3,531 | 307 |

In this case, the purge removed about 2,500 lb/h of hydrocarbons (1,302 lb/h methane, 907 lb/h ethane, and 307 lb/h propane) from the loop, with a concomitant loss of about 700 lb/h of hydrogen.

EXAMPLE 2

A computer calculation was performed to simulate the process of the invention applied to the same off-gas stream as in Example 1. The treatment process was assumed to be carried out according to the process design shown in FIG. 1, with no gas discharged through optional purge line 111; that is, all of stream 107 sent to the membrane unit for treatment. The calculation was carried out to produce a total hydrocarbon removal of about 2,500 lb/h, as in the unselective purge process of Example 1.

Membrane pressure-normalized fluxes were assumed to be as follows, as are typical of a silicone rubber membrane:

| | |
|---|---|
| Hydrogen | $100 \times 10^{-6}$ cm$^3$(STP)/cm$^2$ · cmHg |
| Methane | $140 \times 10^{-6}$ cm$^3$(STP)/cm$^2$ · cmHg |
| Ethane | $350 \times 10^{-6}$ cm$^3$(STP)/cm$^2$ · cmHg |
| Propane | $600 \times 10^{-6}$ cm$^3$(STP)/cm$^2$ · cmHg |

The results of the calculations are shown in Table 2. The stream numbers correspond to FIG. 1.

TABLE 2

| Component / Parameter | Stream 107 (Off-Gas Stream) | Stream 110 (Recycle Stream) | Stream 109 (Permeate Stream) |
|---|---|---|---|
| Molar Flow Rate (lbmol/h) | 5,803 | 5,560 | 243 |
| Mass Flow Rate (lb/h) | 40,185 | 37,329 | 2,856 |
| Temperature (° C.) | 50 | 49 | 49 |
| Pressure (psia) | 1,800 | 1,800 | 50 |
| Component (mol %) | | | |
| Hydrogen | 74.50 | 75.20 | 58.70 |
| Methane | 17.50 | 17.40 | 19.00 |
| Ethane | 6.50 | 6.10 | 16.40 |
| Propane | 1.50 | 1.30 | 5.90 |
| Component (lb/h) | | | |
| Hydrogen | 8,714 | 8,427 | 287 |
| Methane | 16,291 | 15,551 | 740 |
| Ethane | 11,342 | 10,148 | 1,193 |
| Propane | 3,838 | 3,202 | 636 |

Membrane Area = 59 m$^2$

In this case, removal of 2,500 lb/h of hydrocarbons was achieved with a loss of under 300 lb/h of hydrogen, that is, about 40% of the hydrogen loss of the prior art unselective purge. As a result, the hydrogen concentration in the recycle stream is increased from 74.5% to 75.2%.

EXAMPLE 3

The computer calculation of Example 2 was repeated, except that the membrane area was increased to produce a permeate purge of about 1,300 lb/h of methane, as in the unselective purge process of Example 1. In other words, it was assumed that methane was the principal contaminant of concern.

The feed flow rate, stream composition, and all other conditions were as in Example 2.

The results of the calculations are shown in Table 3. The stream numbers correspond to FIG. 1.

TABLE 3

| Component / Parameter | Stream 107 (Off-Gas Stream) | Stream 110 (Recycle Stream) | Stream 109 (Permeate Stream) |
|---|---|---|---|
| Molar Flow Rate (lbmol/h) | 5,803 | 5,377 | 426 |
| Mass Flow Rate (lb/h) | 40,185 | 32,254 | 4,931 |
| Temperature (° C.) | 50 | 49 | 49 |
| Pressure (psia) | 1,800 | 1,800 | 50 |
| Component (mol %) | | | |
| Hydrogen | 74.5 | 75.7 | 59.2 |
| Methane | 17.5 | 17.4 | 19.1 |
| Ethane | 6.5 | 5.7 | 16.0 |
| Propane | 1.5 | 1.2 | 5.7 |
| Component (lb/h) | | | |
| Hydrogen | 8,714 | 8,206 | 509 |
| Methane | 16,291 | 14,988 | 1,304 |
| Ethane | 11,342 | 9,290 | 2,052 |
| Propane | 3,838 | 2,772 | 1,066 |

Membrane = 104 m$^2$

This process design results in a loss of about 500 lb/h of hydrogen, or 70% of the hydrogen loss of the unselective purge process of Example 1. Because the membrane has a higher selectivity for ethane and propane over hydrogen than for methane over hydrogen, the ethane and propane removal in this case is higher than in Example 2, so the total hydrocarbon removal increases to over 4,400 lb/h. These hydrocarbons provide increased NGL production. In addition, the hydrogen concentration in the hydrogen recycle stream is increased by 1.2%.

EXAMPLES 4–8

Comparative calculations were carried out to contrast the performance of the invention with prior art unselective purging in treatment of a hydrotreater off-gas. The calculations were performed using a modeling program, ChemCad III (ChemStations, Inc., Houston, Tex.). The effluent from the hydrotreater was assumed to be passed to a first phase separator, then further cooled, mixed with wash water and passed to a three-phase separator. A portion of the overhead from the three-phase separator was assumed to be withdrawn as a purge stream.

The hydrotreater was assumed to be processing 100,000 lb/h of hydrocarbon feedstock, to produce 118,000 lb/h of raw effluent at 970 psia and 329° C. The composition of this raw effluent stream (stream 304) varies slightly from calculation to calculation, but is approximately as follows:

| | |
|---|---|
| Water vapor | 0.2% |
| Hydrogen | 60.0% |
| Hydrogen Sulfide | 4.5% |
| Ammonia | 0.3% |
| Methane | 15.0% |
| Ethane | 1.3% |
| $C_{3+}$ hydrocarbons | 19.1% |

EXAMPLE 4

Not in Accordance with the Invention

A computer calculation was performed for the prior art, unselective purge case. The process design was assumed to be as in FIGS. 3 and 5, but with the purge simply withdrawn directly from line 307, without passing through a membrane unit. A purge cut of 2% (47 lbmol/h: 2,243 lbmol/h) of the total stream was taken.

The results of the calculations are shown in Table 4. The stream numbers correspond to FIGS. 3 and 5, without the membrane unit.

EXAMPLE 5

The computer calculations were repeated, assuming the invention was carried out according to the process designs of FIGS. 3 and 5. It was assumed, however, that the membrane permeate stream was not recirculated as shown, but was passed instead to downstream treatment. The membrane area and other membrane process parameters were assumed to be adjusted to keep the methane purge rate the same as in Example 4. The feed flow rate, approximate feed composition, temperature, and pressure were assumed to be the same as in Example 4.

Membrane pressure-normalized fluxes were assumed to be as follows, as are typical of a silicone rubber membrane:

| | |
|---|---|
| Water | $1{,}000 \times 10^{-6}$ $cm^3(STP)/cm^2 \cdot sec \cdot cmHg$ |
| Hydrogen | $75 \times 10^{-6}$ $cm^3(STP)/cm^2 \cdot sec \cdot cmHg$ |
| Hydrogen Sulfide | $500 \times 10^{-6}$ $cm^3(STP)/cm^2 \cdot sec \cdot cmHg$ |
| Ammonia | $800 \times 10^{-6}$ $cm^3(STP)/cm^2 \cdot sec \cdot cmHg$ |
| Methane | $100 \times 10^{-6}$ $cm^3(STP)/cm^2 \cdot sec \cdot cmHg$ |
| Ethane | $200 \times 10^{-6}$ $cm^3(STP)/cm^2 \cdot sec \cdot cmHg$ |
| Propane | $300 \times 10^{-6}$ $cm^3(STP)/cm^2 \cdot sec \cdot cmHg$ |
| $C_{6+}$ hydrocarbons | $700 \times 10^{-6}$ $cm^3(STP)/cm^2 \cdot sec \cdot cmHg$ |

The results of the calculations are shown in Table 5. The stream numbers correspond to FIGS. 3 and 5.

TABLE 4

| Component/ Parameter | Stream 303 | Stream 304 | Stream 302 | Recycle Stream | Stream 506 | Stream 512 | Stream 307 | Purge Stream |
|---|---|---|---|---|---|---|---|---|
| Molar Flow Rate (lbmol/h) | 469.3 | 2,844 | 280.0 | 2,196 | 600.2 | 1.6 | 2,243 | 47.0 |
| Mass Flow Rate (lb/h) | 100,000 | 118,001 | 1,252 | 16,748 | 100,699 | 206.8 | 17,106 | 358.6 |
| Temperature (° C.) | 49 | 329 | 313 | 49 | 133 | 49 | 49 | 49 |
| Pressure (psia) | 1,050 | 970 | 1,050 | 935 | 940 | 935 | 935 | 935 |
| Component (mol %) | | | | | | | | |
| Water | 0.0 | 0.2 | 0.0 | 0.2 | 0.1 | 0.2 | 0.2 | 0.2 |
| Hydrogen | 0.0 | 58.2 | 87.5 | 72.7 | 4.2 | 3.6 | 72.7 | 72.7 |
| Hydrogen Sulfide | 0.0 | 5.2 | 0.0 | 5.4 | 4.1 | 11.6 | 5.4 | 5.4 |
| Ammonia | 0.0 | 0.3 | 0.0 | 0.3 | 0.3 | 0.9 | 0.3 | 0.3 |
| Methane | 0.3 | 15.2 | 9.8 | 18.4 | 3.3 | 5.0 | 18.4 | 18.4 |
| Ethane | 0.3 | 1.3 | 1.3 | 1.5 | 0.8 | 1.8 | 1.5 | 1.5 |
| $C_{3+}$ | 99.4 | 19.6 | 1.3 | 1.4 | 87.2 | 77.0 | 1.4 | 1.4 |
| Component (lb/h) | | | | | | | | |
| Hydrogen | 0.0 | 3,338 | 494 | 3,218 | 51 | 0.1 | 3,287 | 69 |
| Hydrogen Sulfide | 0.0 | 4,995 | 0.0 | 4,056 | 847 | 6.2 | 4,143 | 87 |
| Methane | 18.5 | 6,948 | 440 | 6,489 | 319 | 1.3 | 6,628 | 139 |

Actual Horsepower = 158 + 476 hp

TABLE 5

| Component/ Parameter | Stream 303 | Stream 304 | Stream 302 | Stream 310 (Recycle) | Stream 506 | Stream 512 | Stream 307 | Stream 309 (Vent) |
|---|---|---|---|---|---|---|---|---|
| Molar Flow Rate (lbmol/h) | 469.3 | 2,844 | 280.0 | 2,203 | 592.8 | 1.5 | 2,251 | 47.9 |
| Mass Flow Rate (lb/h) | 100,000 | 116,561 | 1,252 | 15,357 | 100,438 | 198.1 | 15,942 | 584.4 |
| Temperature (° C.) | 49 | 329 | 313 | 49 | 133 | 49 | 49 | 48 |
| Pressure (psia) | 1,050 | 970 | 1,050 | 930 | 940 | 935 | 935 | 50 |
| Component (mol %) | | | | | | | | |
| Water | 0.0 | 0.2 | 0.0 | 0.2 | 0.1 | 0.2 | 0.2 | 1.0 |
| Hydrogen | 0.0 | 60.2 | 87.5 | 75.3 | 4.3 | 3.7 | 74.9 | 59.9 |
| Hydrogen Sulfide | 0.0 | 4.3 | 0.0 | 4.3 | 3.4 | 9.7 | 4.5 | 14.1 |
| Ammonia | 0.0 | 0.2 | 0.0 | 0.2 | 0.2 | 0.7 | 0.3 | 1.0 |
| Methane | 0.3 | 14.5 | 9.8 | 17.5 | 3.1 | 4.8 | 17.5 | 17.9 |
| Ethane | 0.3 | 1.2 | 1.3 | 1.3 | 0.7 | 1.6 | 1.3 | 2.4 |
| $C_{3+}$ | 99.4 | 19.5 | 1.3 | 1.2 | 88.2 | 79.2 | 1.2 | 3.8 |
| Component (lb/h) | | | | | | | | |
| Hydrogen | 0.0 | 3,452 | 494 | 3,342 | 51.8 | 0.1 | 3,400 | 57.8 |
| Hydrogen Sulfide | 0.0 | 4,127 | 0.0 | 3,198 | 694 | 4.9 | 3,429 | 231 |
| Methane | 18.5 | 6,610 | 440 | 6,172 | 299 | 1.1 | 6,310 | 138 |

Membrane Area = 30 $m^2$
Actual Horsepower = 167 + 476 hp

EXAMPLE 6

The calculation of Example 5 was repeated, this time keeping the hydrogen sulfide purge rate the same as in Example 4. The membrane fluxes were as in Example 5.

The results of the calculations are shown in Table 6. The stream numbers correspond to FIGS. 3 and 5.

TABLE 6

| Component/ Parameter | Stream 303 | Stream 304 | Stream 302 | Stream 310 (Recycle) | Stream 506 | Stream 512 | Stream 307 | Stream 309 (Vent) |
|---|---|---|---|---|---|---|---|---|
| Molar Flow Rate (lbmol/h) | 469.3 | 2,844 | 280.0 | 2,233 | 597.3 | 1.5 | 2,246 | 13.5 |
| Mass Flow Rate (lb/h) | 100,000 | 117,457 | 1,252 | 16,474 | 100,597 | 204.0 | 16,665 | 191.1 |
| Temperature (° C.) | 49 | 329 | 313 | 49 | 133 | 49 | 49 | 49 |
| Pressure (psia) | 1,050 | 970 | 1,050 | 930 | 940 | 935 | 935 | 50 |
| Component (mol %) | | | | | | | | |
| Water | 0.0 | 0.2 | 0.0 | 0.2 | 0.1 | 0.2 | 0.2 | 1.3 |
| Hydrogen | 0.0 | 59.0 | 87.5 | 73.7 | 4.3 | 3.6 | 73.5 | 54.1 |
| Hydrogen Sulfide | 0.0 | 4.8 | 0.0 | 5.0 | 3.9 | 10.8 | 5.0 | 18.7 |
| Ammonia | 0.0 | 0.3 | 0.0 | 0.3 | 0.2 | 0.8 | 0.3 | 1.4 |
| Methane | 0.3 | 15.0 | 9.8 | 18.1 | 3.2 | 4.9 | 18.1 | 17.4 |
| Ethane | 0.3 | 1.3 | 1.3 | 1.4 | 0.7 | 1.7 | 1.4 | 2.6 |
| $C_{3+}$ | 99.4 | 19.6 | 1.3 | 1.4 | 87.6 | 78.0 | 1.4 | 4.6 |
| Component (lb/h) | | | | | | | | |
| Hydrogen | 0.0 | 3,381 | 494 | 3,315 | 51 | 0.1 | 3,330 | 15 |
| Hydrogen Sulfide | 0.0 | 4,649 | 0.0 | 3,771 | 785 | 5.7 | 3,857 | 86 |
| Methane | 18.5 | 6,829 | 440 | 6,477 | 311 | 1.2 | 6,514 | 38 |

Membrane Area = 8 $m^2$
Actual Horsepower = 169 + 476 hp

EXAMPLE 7

The calculation of Example 5 was repeated, this time keeping the hydrogen purge rate the same as in Example 4. The membrane fluxes were as in Example 5.

The results of the calculations are shown in Table 7. The stream numbers correspond to FIGS. 3 and 5.

TABLE 7

| Component/ Parameter | Stream 303 | Stream 304 | Stream 302 | Stream 310 (Recycle) | Stream 506 | Stream 512 | Stream 307 | Stream 309 (Vent) |
|---|---|---|---|---|---|---|---|---|
| Molar Flow Rate (lbmol/h) | 469.3 | 2,844 | 280.0 | 2,196 | 592.2 | 1.5 | 2,251 | 55.8 |
| Mass Flow Rate (lb/h) | 100,000 | 116,435 | 1,252 | 15,180 | 100,415 | 197.5 | 15,841 | 660.5 |
| Temperature (° C.) | 49 | 329 | 313 | 49 | 133 | 49 | 49 | 47 |
| Pressure (psia) | 1,050 | 970 | 1,050 | 930 | 940 | 935 | 935 | 50 |
| Component (mol %) | | | | | | | | |
| Water | 0.0 | 0.2 | 0.0 | 0.2 | 0.1 | 0.2 | 0.2 | 0.9 |
| Hydrogen | 0.0 | 60.4 | 87.5 | 75.5 | 4.3 | 3.7 | 75.1 | 60.9 |
| Hydrogen Sulfide | 0.0 | 4.2 | 0.0 | 4.2 | 3.4 | 9.6 | 4.4 | 13.4 |
| Ammonia | 0.0 | 0.2 | 0.0 | 0.2 | 0.2 | 0.7 | 0.2 | 0.9 |
| Methane | 0.3 | 14.4 | 9.8 | 17.4 | 3.1 | 4.8 | 17.4 | 18.0 |
| Ethane | 0.3 | 1.2 | 1.3 | 1.3 | 0.7 | 1.6 | 1.3 | 2.3 |
| $C_{3+}$ | 99.4 | 19.5 | 1.3 | 1.2 | 87.2 | 79.4 | 1.2 | 3.5 |
| Component (lb/h) | | | | | | | | |
| Hydrogen | 0.0 | 3,462 | 494 | 3,341 | 52 | 0.1 | 3,410 | 69 |
| Hydrogen Sulfide | 0.0 | 4,058 | 0.0 | 3,118 | 681 | 4.8 | 3,372 | 254 |
| Methane | 18.5 | 6,578 | 440 | 6,119 | 297 | 1.1 | 6,280 | 162 |

Membrane Area = 36 $m^2$
Actual Horsepower = 167 + 476 hp

EXAMPLE 8

Comparison of Examples 4–7

The degree of hydrogen sulfide removal and the loss of hydrogen from the hydrogen recycle stream to the reactor was compared for the unselective purge process of Example 4 and the membrane processes of Examples 5–7. The results are shown in Table 8.

TABLE 8

| Example # | $H_2$ Loss (lb/h) | $H_2S$ Removed (lb/h) | $CH_4$ Removed (lb/h) | $H_2$ in Recycle (mol %) | $H_2S$ in Recycle (mol %) | Membrane Area ($m^2$) | Actual Comp Horsepower (hp) |
|---|---|---|---|---|---|---|---|
| 4 (Unselective Purge) | 68.9 | 86.8 | 138.9 | 72.7 | 5.4 | — | 158 + 476 |
| 5 (Same Methane Purge) | 57.8 | 230.9 | 137.8 | 75.3 | 4.3 | 30 | 167 + 476 |
| 6 (Same $H_2S$ Purge) | 14.7 | 85.6 | 37.6 | 73.7 | 5.0 | 8 | 169 + 476 |
| 7 (Same Hydrogen Purge) | 68.6 | 253.9 | 161.5 | 75.5 | 4.2 | 36 | 167 + 476 |

As can be seen in Table 8, the unselective purge process of Example 4 results in a loss of about 70 lb/h of hydrogen in the purge stream and maintains a hydrogen concentration of 72.7% and a hydrogen sulfide concentration of 5.4% in the recycle loop.

When the process of the invention is carried out to produce a methane removal of about 140 lb/h as in Example 4, there is a nearly three-fold increase in removal of hydrogen sulfide. In addition, the hydrogen loss is reduced from about 69 lb/h to 58 lb/h, and the hydrogen concentration in the recycle stream is increased 2.6%.

When the process of the invention is carried out to produce a hydrogen sulfide removal of about 86 lb/h as in Example 4, the hydrogen loss is reduced to only 21% of that of the unselective purge process. This results in a 1.0% increase in the concentration of hydrogen in the recycle stream.

When the process of the invention is carried out to produce a hydrogen loss of about 69 lb/h as in Example 4, there is a full three-fold increase in removal of hydrogen sulfide, and the concentration of hydrogen in the recycle stream is increased by 2.8%. There is also a 16% increase in the methane removal over the unselective purge process.

The greatest hydrogen recovery is achieved in the case of the same hydrogen sulfide removal as in the unselective purge. However, this process does not remove much methane from the recycle stream. The best hydrogen sulfide removal is achieved in the case of the same hydrogen loss as in the unselective purge. This process also achieves the best methane removal and the highest hydrogen concentration in the recycle stream. Thus, it will be apparent to those skilled in the art that the process of the invention can be tailored to meet the needs of the various refinery operations at any given time.

EXAMPLES 9–15

Comparative calculations were carried out to contrast the performance of the invention with prior art unselective purging for controlling the concentration of hydrogen sulfide in a hydrogen recycle stream to a hydrodesulfurization process. The calculations were performed using a modeling program, ChemCad III (ChemStations, Inc., Houston, Tex.), to simulate the treatment of a typical off-gas stream from a phase separator of a hydrodesulfurization process.

The off-gas stream from the phase separator was assumed to have a flow rate of 50 MMscfd, to be at a temperature of 50° C. and a pressure of 700 psia, and and to be of the following approximate volume composition:

| | |
|---|---|
| Hydrogen | 70% |
| Hydrogen Sulfide | 7% |
| Methane | 15% |
| Ethane | 5% |
| n-Butane | 3% |

EXAMPLE 9

Not in Accordance with the Invention

A calculation was performed for the prior art, unselective purge case. It was assumed that purging was performed simply by withdrawing 7%, or 3.5 MMscfd, of the gas from the phase separator overhead, and recirculating the remainder of the overhead stream to the reactor. In a 50-MMscfd stream, the purging of 3.5 MMscfd of gas results in a removal of about 970 lb/h of hydrogen sulfide. At the same time, about 2.45 MMscfd (570 lb/h) of hydrogen is lost in the purge stream.

EXAMPLE 10

A series of computer calculations was performed, assuming now that purging was carried out according to the embodiment of the invention as shown in FIG. 4.

Membrane pressure-normalized fluxes were assumed to be as follows, as are typical of a Pebax 4011 membrane:

| | |
|---|---|
| Hydrogen | $5 \times 10^{-6}$ cm$^3$(STP)/cm$^2$ · sec · cmHg |
| Hydrogen Sulfide | $150 \times 10^{-6}$ cm$^3$(STP)/cm$^2$ · sec · cmHg |
| Methane | $5 \times 10^{-6}$ cm$^3$(STP)/cm$^2$ · sec · cmHg |
| Ethane | $10 \times 10^{-6}$ cm$^3$(STP)/cm$^2$ · sec · cmHg |
| n-Butane | $20 \times 10^{-6}$ cm$^3$(STP)/cm$^2$ · sec · cmHg |

Assuming these membrane properties, the membrane permeate stream, 409, contains less than 50% hydrogen sulfide. It was assumed, therefore, that the additional treatment process, 411, consists of two further membrane treatments to raise the hydrogen sulfide concentration to about 90% in stream 412, to facilitate disposal or conversion to elemental sulfur.

Figure 6:
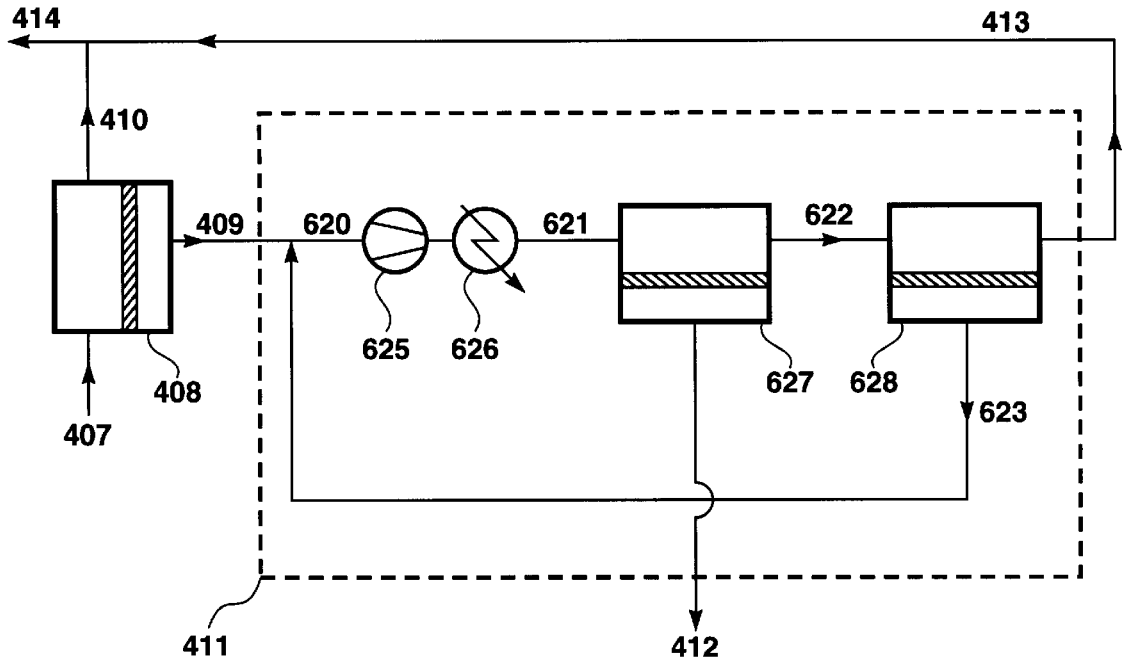
FIG. 6 is a schematic drawing showing an embodiment of the permeate treatment step of FIG. 4 in more detail.

FIG. 6 gives the additional treatment process, 411, indicated overall by the dashed line, broken down in more detail to show how the further membrane treatments are incorporated into the overall scheme.

In FIG. 6, stream 409 is mixed with third membrane permeate stream 623, to form combined stream 620, which is compressed in compressor 625 and cooled in chiller 626. The resultant stream, 621, forms the feed to the second membrane unit, 627. This unit produces a concentrated hydrogen sulfide liquid permeate, withdrawn as stream 412, and a hydrogen-sulfide-depleted residue, 622, which passes to a third membrane unit, 628. The third membrane permeate, 623, is combined with first permeate 409 to form stream 620. The hydrogen-enriched third residue stream, 413, is combined with the first residue stream, 410, to form stream 414 for recirculation to the reactor or other use elsewhere in the plant.

Membrane units 627 and 628 were assumed to contain the same Pebax 4011 membranes as unit 408. The membrane area of the membrane units was adjusted to achieve the same hydrogen sulfide removal (970 lb/h) as the prior art case.

The results of the calculations are shown in Table 9. The stream numbers correspond to FIGS. 4 and 6.

TABLE 9

| | Stream | | | | | | | | | |
|---|---|---|---|---|---|---|---|---|---|---|
| | 407 | 410 | 409 | 620 | 621 | 412 | 622 | 413 | 414 | 623 |
| Flow (lbmol/h) | 5,803 | 5,741 | 61.9 | 70.8 | 70.8 | 31.2 | 39.6 | 30.7 | 5,771 | 8.9 |
| Mass flow (lb/h) | 54,835 | 53,412 | 1,423 | 1,689 | 1,689 | 1,034 | 654.0 | 388.7 | 53,800 | 265.3 |
| Temp. (° C.) | 50 | 50 | 50 | 49 | 40 | 40 | 40 | 43 | 50 | 43 |
| Pressure (psia) | 700 | 700 | 50 | 50 | 700 | 50 | 700 | 700 | 700 | 50 |
| Component (mol %): | | | | | | | | | | |
| Hydrogen | 70.0 | 70.4 | 33.8 | 31.7 | 31.7 | 4.3 | 53.3 | 63.9 | 70.4 | 16.9 |
| Hydrogen Sulfide | 7.0 | 6.5 | 49.0 | 51.2 | 51.2 | 90.8 | 20.0 | 6.5 | 6.5 | 66.5 |
| Methane | 15.0 | 15.1 | 7.3 | 6.8 | 6.8 | 0.9 | 11.4 | 13.7 | 15.1 | 3.6 |
| Ethane | 5.0 | 5.0 | 4.7 | 4.6 | 4.6 | 1.2 | 7.3 | 8.2 | 5.0 | 4.4 |
| n-Butane | 3.0 | 3.0 | 5.2 | 5.6 | 5.6 | 2.8 | 7.9 | 7.7 | 3.0 | 8.6 |
| Component (lb/h) | | | | | | | | | | |
| Hydrogen | 8,188 | 8,146 | 42.2 | 45.3 | 45.3 | 2.7 | 42.5 | 39.5 | 8,185 | 3.0 |
| Hydrogen Sulfide | 13,841 | 12,807 | 1,034 | 1,235 | 1,235 | 966 | 270 | 68.4 | 12,875 | 201 |

Membrane area = 482 + 50 + 40 m$^2$
Theoretical horsepower = 112 hp

EXAMPLE 11

The calculation of Example 10 was repeated, except that the membrane area of the membrane units was adjusted to produce a hydrogen recycle stream containing only 6% hydrogen sulfide, instead of 7% as in the prior art case. All other conditions were as in Example 10. The results of the calculations are shown in Table 10.

TABLE 10

| | Stream | | | | | | | | | |
|---|---|---|---|---|---|---|---|---|---|---|
| | 407 | 410 | 409 | 620 | 621 | 412 | 622 | 413 | 414 | 623 |
| Flow (lbmol/h) | 5,803 | 5,663 | 139.3 | 161.1 | 161.1 | 68.6 | 92.5 | 70.7 | 5,734 | 21.8 |
| Mass flow (lb/h) | 54,835 | 51,680 | 3,155 | 3,803 | 3,803 | 2,271 | 1,532 | 883.8 | 52,564 | 647.8 |
| Temp. (° C.) | 50 | 50 | 50 | 48 | 33 | 33 | 33 | 43 | 49 | 43 |
| Pressure (psia) | 700 | 700 | 50 | 50 | 700 | 50 | 700 | 700 | 700 | 50 |
| Component (mol %): | | | | | | | | | | |
| Hydrogen | 70.0 | 70.9 | 34.8 | 32.5 | 32.5 | 4.4 | 53.3 | 64.3 | 70.8 | 17.5 |
| Hydrogen Sulfide | 7.0 | 6.0 | 47.6 | 50.0 | 50.0 | 90.5 | 20.0 | 6.0 | 6.0 | 65.5 |
| Methane | 15.0 | 15.2 | 7.5 | 7.0 | 7.0 | 1.0 | 11.4 | 13.8 | 15.2 | 3.7 |
| Ethane | 5.0 | 5.0 | 4.8 | 4.7 | 4.7 | 1.3 | 7.3 | 8.2 | 5.0 | 4.5 |
| n-Butane | 3.0 | 3.0 | 5.3 | 5.8 | 5.8 | 2.8 | 8.0 | 7.7 | 3.0 | 8.8 |
| Component (lb/h) | | | | | | | | | | |
| Hydrogen | 8,188 | 8,090 | 97.8 | 105 | 105 | 6.1 | 99.3 | 91.6 | 8,182 | 7.7 |
| Hydrogen Sulfide | 11,725 | 11,580 | 2,260 | 2,746 | 2,746 | 2,116 | 631 | 145 | 11,725 | 486 |

Membrane area = 1,114 + 112 + 102 $m^2$
Theoretical horsepower = 253 hp

EXAMPLE 12

The calculation of Example 10 was repeated, except that the membrane area of the membrane units was adjusted to produce a hydrogen recycle stream containing only 5% hydrogen sulfide. All other conditions were as in Example 10. The results of the calculations are shown in Table 11.

TABLE 11

| | Stream | | | | | | | | | |
|---|---|---|---|---|---|---|---|---|---|---|
| | 407 | 410 | 409 | 620 | 621 | 412 | 622 | 413 | 414 | 623 |
| Flow (lbmol/h) | 5,803 | 5,511 | 291.9 | 345.6 | 345.6 | 136.8 | 208.9 | 155.1 | 5,666 | 53.7 |
| Mass flow (lb/h) | 54,835 | 48,423 | 6,412 | 7,994 | 7,994 | 4,521 | 3,472 | 1,890 | 50,313 | 1,582 |
| Temp. (° C.) | 50 | 49 | 49 | 48 | 34 | 34 | 34 | 42 | 49 | 42 |
| Pressure (psia) | 700 | 700 | 50 | 50 | 700 | 50 | 700 | 700 | 700 | 50 |
| Component (mol %): | | | | | | | | | | |
| Hydrogen | 70.0 | 71.8 | 36.8 | 34.0 | 34.0 | 4.7 | 53.2 | 65.1 | 71.6 | 18.6 |
| Hydrogen Sulfide | 7.0 | 5.0 | 44.8 | 47.7 | 47.7 | 90.0 | 20.0 | 5.0 | 5.0 | 63.3 |
| Methane | 15.0 | 15.4 | 7.9 | 7.3 | 7.3 | 1.0 | 11.4 | 14.0 | 15.3 | 4.0 |
| Ethane | 5.0 | 5.0 | 5.0 | 5.0 | 5.0 | 1.3 | 7.4 | 8.3 | 5.1 | 4.8 |
| n-Butane | 3.0 | 2.9 | 5.5 | 6.1 | 6.1 | 3.0 | 8.1 | 7.6 | 3.0 | 9.3 |
| Component (lb/h) | | | | | | | | | | |
| Hydrogen | 8,188 | 7,971 | 217 | 237 | 237 | 13.0 | 224 | 204 | 8,175 | 237 |
| Hydrogen Sulfide | 13,841 | 9,387 | 4,454 | 5,613 | 5,613 | 4,190 | 1,423 | 264 | 9,651 | 5,613 |

Membrane area = 2,457 + 233 + 266 $m^2$
Theoretical horsepower = 543 hp

EXAMPLE 13

The calculation of Example 10 was repeated, except that the membrane area of the membrane units was sized to produce a hydrogen recycle stream containing only 4% hydrogen sulfide. All other conditions were as in Example 10. The results of the calculations are shown in Table 12.

TABLE 12

| | Stream | | | | | | | | | |
|---|---|---|---|---|---|---|---|---|---|---|
| | 407 | 410 | 409 | 620 | 621 | 412 | 622 | 413 | 414 | 623 |
| Flow (lbmol/h) | 5,803 | 5,340 | 462.9 | 564.5 | 564.5 | 204.3 | 360.2 | 258.6 | 5,598 | 101.6 |
| Mass flow (lb/h) | 54,835 | 45,028 | 9,807 | 12,761 | 12,761 | 6,743 | 6,018 | 3,063 | 48,091 | 2,954 |
| Temp. (° C.) | 50 | 49 | 49 | 47 | 35 | 35 | 35 | 41 | 48 | 41 |
| Pressure (psia) | 700 | 700 | 50 | 50 | 700 | 50 | 700 | 700 | 700 | 50 |
| Component (mol %): | | | | | | | | | | |
| Hydrogen | 70.0 | 72.7 | 39.1 | 35.6 | 35.6 | 5.0 | 53.0 | 66.0 | 72.4 | 19.9 |
| Hydrogen Sulfide | 7.0 | 4.0 | 41.6 | 45.0 | 45.0 | 89.2 | 20.0 | 4.0 | 4.0 | 60.7 |
| Methane | 15.0 | 15.6 | 8.4 | 7.6 | 7.6 | 1.1 | 11.4 | 14.1 | 15.5 | 4.3 |
| Ethane | 5.0 | 5.0 | 5.3 | 5.2 | 5.2 | 1.4 | 7.4 | 8.3 | 5.1 | 5.2 |
| n-Butane | 3.0 | 2.8 | 5.7 | 6.4 | 6.4 | 3.3 | 8.2 | 7.5 | 3.0 | 9.9 |
| Component (lb/h) | | | | | | | | | | |
| Hydrogen | 8,188 | 7,823 | 365 | 406 | 406 | 20.6 | 385 | 344 | 8,167 | 40.8 |
| Hydrogen Sulfide | 13,841 | 7,277 | 6,564 | 8,665 | 8,665 | 6,211 | 2,454 | 352 | 7,629 | 2,101 |

Membrane area = 4,115 + 363 + 534 $m^2$
Theoretical horsepower = 883 hp

EXAMPLE 14

The calculation of Example 10 was repeated, except that the membrane area of the membrane units was sized to produce a hydrogen recycle stream containing only 3% hydrogen sulfide. All other conditions were as in Example 10. The results of the calculations are shown in Table 13.

TABLE 13

| | Stream | | | | | | | | | |
|---|---|---|---|---|---|---|---|---|---|---|
| | 407 | 410 | 409 | 620 | 621 | 412 | 622 | 413 | 414 | 623 |
| Flow (lbmol/h) | 5,803 | 5,136 | 666.4 | 844.8 | 844.8 | 271.8 | 573.0 | 394.5 | 5,531 | 178.4 |
| Mass flow (lb/h) | 54,835 | 41,354 | 13,481 | 18,594 | 18,594 | 8,955 | 9,639 | 4,526 | 45,879 | 5,113 |
| Temp. (° C.) | 50 | 48 | 48 | 46 | 37 | 37 | 37 | 41 | 48 | 41 |
| Pressure (psia) | 700 | 700 | 50 | 50 | 700 | 50 | 700 | 700 | 700 | 50 |
| Component (mol %): | | | | | | | | | | |
| Hydrogen | 70.0 | 73.7 | 41.8 | 37.6 | 37.6 | 5.4 | 52.8 | 66.9 | 73.2 | 21.6 |
| Hydrogen Sulfide | 7.0 | 3.0 | 37.8 | 42.0 | 42.0 | 88.4 | 20.0 | 3.0 | 3.0 | 57.6 |
| Methane | 15.0 | 15.8 | 9.0 | 8.0 | 8.0 | 1.1 | 11.3 | 14.3 | 15.7 | 4.6 |
| Ethane | 5.0 | 4.9 | 5.6 | 5.6 | 5.6 | 1.5 | 7.5 | 8.3 | 5.2 | 5.6 |
| n-Butane | 3.0 | 2.6 | 5.8 | 6.8 | 6.8 | 3.6 | 8.4 | 7.4 | 3.0 | 10.6 |
| Component (lb/h) | | | | | | | | | | |
| Hydrogen | 8,188 | 7,626 | 562 | 639 | 639 | 29.4 | 610 | 532 | 8,158 | 77.6 |
| Hydrogen Sulfide | 13,841 | 5,253 | 8,588 | 12,089 | 12,089 | 8,185 | 3,904 | 403 | 5,656 | 3,501 |

Membrane area = 6,303 + 509 + 1,007 $m^2$
Theoretical horsepower = 1,317 hp

Example 15

Comparison of Examples 9–14

The degree of hydrogen sulfide removal and the loss of hydrogen from the hydrogen recycle stream to the reactor was compared for the unselective purge process of Example 9 and the process of the invention of Examples 10–14. The results are shown in Table 14.

TABLE 14

| Example Number | $H_2S$ in Hydrogen Recycle (%) (Stream 410) | $H_2S$ Removal (lb/h) (Stream 412) | $H_2$ Loss (lb/h) (Stream 412) | Membrane Area ($m^2$) | Theoretical Compressor Horsepower (hp) |
|---|---|---|---|---|---|
| 9 | 7.0 | 967 | 573 | — | — |
| 10 | 6.5 | 966 | 2.7 | 572 | 112 |
| 11 | 6.0 | 2,116 | 6.1 | 1,328 | 253 |
| 12 | 5.0 | 4,190 | 13.0 | 2,956 | 543 |
| 13 | 4.0 | 6,211 | 20.6 | 5,012 | 883 |
| 14 | 3.0 | 8,185 | 29.4 | 7,819 | 1,317 |

Comparing Examples 9 and 10 shows that the invention achieves the same degree of hydrogen sulfide purging as the prior art process, that is about 970 lb/h, with a hydrogen loss of only 3 lb/h, compared with a hydrogen loss of 570 lb/h for the prior art process.

Examples 11–14 show that much higher levels of hydrogen sulfide removal are also possible, combined with extremely low hydrogen losses. These results require larger membrane areas and greater compressor capacity, however.

Thus, it will be apparent to those skilled in the art that the process of the invention can be tailored to meet the needs of the various refinery operations at any given time.

We claim:

1. A process of hydroprocessing a fluid stream comprising hydrogen, a sulfur compound, and hydrocarbons, the process comprising the steps of:

(a) hydroprocessing the fluid stream;

(b) subjecting an effluent, wherein the effluent comprises hydrogen sulfide, from the hydroprocessing step to at least one phase separation step, thereby producing a vapor stream comprising hydrogen, hydrogen sulfide, and a light hydrocarbon;

(c) performing a membrane separation step, comprising passing at least a portion of the vapor stream across a feed side of a polymeric membrane selective to the light hydrocarbon and hydrogen sulfide over hydrogen;

(d) withdrawing from a permeate side of the polymeric membrane a permeate stream enriched in hydrogen sulfide and the light hydrocarbon compared to the vapor stream;

(e) withdrawing from the feed side a residue stream enriched in hydrogen compared to the vapor stream;

recycling at least a portion of the residue stream to the hydroprocessing step.

2. The process of claim 1, wherein the hydroprocessing step comprises hydrotreating.

3. The process of claim 1, wherein the hydroprocessing step comprises hydrocracking.

4. The process of claim 1, wherein the hydroprocessing step comprises hydrodesulfurization.

5. The process of claim 1, wherein the polymeric membrane comprises silicone rubber.

6. The process of claim 1, wherein the polymeric membrane comprises a polymer having repeating units of

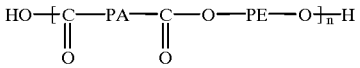

wherein PA is a polyamide segment, PE is a polyether segment, and n is a positive integer.

7. The process of claim 1, wherein the polymeric membrane comprises a super-glassy polymer.

8. The process of claim 1, wherein the permeate stream has a hydrogen concentration at least about 1.5 times lower than the vapor stream.

9. The process of claim 1, wherein the permeate stream has a hydrogen concentration at least about 2 times lower than the vapor stream.

10. The process of claim 1, wherein the residue stream has a hydrogen concentration no more than 5% higher than the vapor stream.

11. The process of claim 1, wherein the residue stream has a hydrogen concentration no more than 2% higher than the vapor stream.

12. The process of claim 1, further comprising subjecting at least a portion of the residue stream to additional treatment.

13. The process of claim 1, further comprising subjecting the permeate stream to additional treatment.

14. The process of claim 1, further comprising treatment to remove at least a portion of the hydrogen sulfide from the effluent prior to performing the membrane separation step.

15. The process of claim 14, wherein the treatment comprises water washing.

16. The process of claim 14, wherein the treatment comprises amine scrubbing.

17. A process of hydroprocessing a fluid stream comprising hydrogen and hydrocarbons comprising providing selective purging of light hydrocarbons from a hydroprocessor reactor recycle loop by carrying out the steps of:

(a) hydroprocessing the fluid stream;

(b) subjecting an effluent from the hydroprocessing step to at least one phase separation step, thereby producing a vapor stream comprising hydrogen and a light hydrocarbon;

(c) performing a membrane separation step, comprising passing at least a portion of the vapor stream across a feed side of a polymeric membrane selective to the light hydrocarbon over hydrogen;

(d) withdrawing from a permeate side of the polymeric membrane a permeate stream enriched in the light hydrocarbon compared to the vapor stream;

(e) withdrawing from the feed side a residue stream enriched in hydrogen compared to the vapor stream;

(f) completing the hydroprocessor reactor recycle loop by recycling at least a portion of the residue stream to the hydroprocessing step.

18. The process of claim 17, wherein the effluent comprises hydrogen sulfide.

19. The process of claim 17, wherein the hydroprocessing step comprises hydrocracking.

20. The process of claim 17, wherein the hydroprocessing step comprises hydrotreating.

21. The process of claim 17, wherein the hydroprocessing step comprises hydrodesulfurization.

22. The process of claim 17, wherein the polymeric membrane comprises silicone rubber.

23. The process of claim 17, wherein the polymeric membrane comprises a polymer having repeating units of

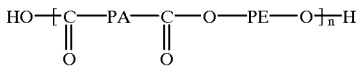

wherein PA is a polyamide segment, PE is a polyether segment, and n is a positive integer.

24. The process of claim 17, wherein the polymeric membrane comprises a super-glassy polymer.

25. The process of claim 17, wherein the permeate stream has a hydrogen concentration at least about 1.5 times lower than the vapor stream.

26. The process of claim 17, wherein the permeate stream has a hydrogen concentration at least about 2 times lower than the vapor stream.

27. The process of claim 17, wherein the residue stream has a hydrogen concentration no more than 5% higher than the vapor stream.

28. The process of claim 17, wherein the residue stream has a hydrogen concentration no more than 2% higher than the vapor stream.

29. The process of claim 17, further comprising subjecting at least a portion of the residue stream to additional treatment.

30. The process of claim 17, further comprising subjecting the permeate stream to additional treatment.

31. The process of claim 18, further comprising treatment to remove at least a portion of the hydrogen sulfide prior to performing the membrane separation step.

32. The process of claim 17, further comprising recirculating the permeate stream to the at least one phase separation step.

33. A process for hydroprocessing a fluid stream comprising hydrogen and hydrocarbons, the process comprising the steps of:

(a) hydroprocessing the fluid stream;

(b) subjecting an effluent from the hydroprocessing step to a first phase-separation step at a first pressure, thereby producing a first vapor stream and a first liquid stream;

(c) subjecting the first liquid stream to a second phase-separation step at a second pressure, the second pressure being lower than the first pressure, thereby producing a second vapor stream, comprising a light hydrocarbon and hydrogen, and a second liquid stream;

(d) performing a membrane separation step, comprising passing at least a portion of the second vapor stream across a feed side of a polymeric membrane selective to the light hydrocarbon over hydrogen;

(e) withdrawing from a permeate side of the polymeric membrane a permeate stream enriched in the light hydrocarbon compared to the second vapor stream;

(f) withdrawing from the feed side a residue stream enriched in hydrogen compared to the second vapor stream.

34. The process of claim 33, wherein the effluent comprises hydrogen sulfide.

35. The process of claim 33, wherein the polymeric membrane comprises silicone rubber.

36. The process of claim 33, wherein the permeate stream has a hydrogen concentration at least about 2 times lower than the vapor stream.

37. The process of claim 33, wherein the residue stream has a hydrogen concentration no more than 2% higher than the vapor stream.

38. The process of claim 33, further comprising subjecting at least a portion of the residue stream to additional treatment.

39. The process of claim 33, further comprising subjecting the permeate stream to additional treatment.

40. A process of hydroprocessing a fluid stream comprising at least hydrogen and hydrocarbons comprising providing selective purging of light hydrocarbons from a hydroprocessor reactor recycle loop by carrying out the steps of:

(a) hydroprocessing the fluid stream;

(b) subjecting an effluent from the hydroprocessing step to at least one phase separation step, thereby producing a vapor stream comprising hydrogen and a light hydrocarbon;

(c) completing the hydroprocessor reactor recycle loop by recycling a first portion of the vapor stream to the hydroprocessing step;

(d) performing a membrane separation step, comprising passing a second portion of the vapor stream across a feed side of a polymeric membrane selective to the light hydrocarbon over hydrogen;

(e) withdrawing from a permeate side of the polymeric membrane a permeate stream enriched in the light hydrocarbon compared to the vapor stream;

(f) withdrawing from the feed side a residue stream enriched in hydrogen compared to the vapor stream.

41. The process of claim 40, wherein the effluent comprises hydrogen sulfide.

42. The process of claim 40, wherein the hydroprocessing step comprises hydrodesulfurization.

43. The process of claim 40, wherein the polymeric membrane comprises silicone rubber.

44. The process of claim 40, wherein the permeate stream has a hydrogen concentration at least about 2 times lower than the vapor stream.

45. The process of claim 40, further comprising subjecting at least a portion of the residue stream to additional treatment.

46. The process of claim 45, wherein the additional treatment comprises PSA.

47. The process of claim 45, wherein the additional treatment comprises membrane separation using a hydrogen-selective membrane.

48. The process of claim 40, further comprising subjecting the permeate stream to additional treatment.

* * * * *